US009562655B2

(12) United States Patent
Villard

(10) Patent No.: US 9,562,655 B2
(45) Date of Patent: Feb. 7, 2017

(54) LED LIGHTING FIXTURE

(71) Applicant: Cree, Inc., Durham, NC (US)

(72) Inventor: Russell G. Villard, Apex, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/082,932

(22) Filed: Nov. 18, 2013

(65) Prior Publication Data

US 2014/0140052 A1 May 22, 2014

Related U.S. Application Data

(63) Continuation of application No. 13/371,214, filed on Feb. 10, 2012, now Pat. No. 8,646,944, which is a (Continued)

(51) Int. Cl.

| | |
|---|---|
| ***F21K 99/00*** | (2016.01) |
| ***F21V 14/02*** | (2006.01) |
| ***F21V 19/02*** | (2006.01) |
| *F21S 8/08* | (2006.01) |
| *F21W 131/103* | (2006.01) |
| *F21Y 101/00* | (2016.01) |

(52) U.S. Cl.

CPC . *F21K 9/58* (2013.01); *F21K 9/65* (2016.08); *F21K 9/90* (2013.01); *F21S 4/20* (2016.01); *F21V 14/02* (2013.01); *F21V 19/02* (2013.01); *F21S 8/08* (2013.01); *F21W 2131/103* (2013.01); *F21Y 2101/00* (2013.01); *F21Y 2105/10* (2016.08); *F21Y 2107/50* (2016.08); *F21Y 2115/10* (2016.08); *Y10T 29/4913* (2015.01)

(58) Field of Classification Search

CPC ..... F21K 9/58; F21K 9/90; F21K 99/00; F21V 14/02; F21V 19/02; F21V 19/001; F21V 21/14; F21V 21/00; F21V 5/00; F21V 5/007; F21Y 2105/001; F21Y 2101/02; F21Y 2105/005; F21S 8/08; F21S 4/003; F21S 4/00; F21S 4/20; F21W 2131/103; Y10T 29/4913

See application file for complete search history.

(56) References Cited

U.S. PATENT DOCUMENTS

| | | | |
|---|---|---|---|
| 2,295,339 | A | 9/1942 | Ericson |
| 2,907,870 | A | 10/1959 | Calmes |

(Continued)

FOREIGN PATENT DOCUMENTS

| | | |
|---|---|---|
| EP | 1081771 | 3/2001 |
| EP | 1111966 | 6/2001 |

(Continued)

OTHER PUBLICATIONS

Final Office Action for U.S. Appl. No. 12/911,204 dated Feb. 20, 2015.

(Continued)

*Primary Examiner* — Bao Q Truong

(74) *Attorney, Agent, or Firm* — Jenkins, Wilson, Taylor & Hunt, P.A.

(57) ABSTRACT

A light emitting diode (LED) lighting fixture for achieving a desired illumination pattern includes a support plate and a plurality of panels Connected to the support plate. Each panel has an array of LEDs mounted to a planar surface thereof, and each of the panels is rotatable in at least two dimensions.

22 Claims, 13 Drawing Sheets

Related U.S. Application Data continuation of application No. 12/710,079, filed on Feb. 22, 2010, now Pat. No. 8,118,450, which is a continuation of application No. 11/689,875, filed on Mar. 22, 2007, now Pat. No. 7,665,862, which is a continuation-in-part of application No. 11/519,058, filed on Sep. 12, 2006, now Pat. No. 7,766,508.

(56) References Cited

U.S. PATENT DOCUMENTS

| | | | | |
|---|---|---|---|---|
| 3,805,937 | A | 4/1974 | Hatanaka et al. | |
| 3,927,290 | A | 12/1975 | Denley | |
| 4,325,146 | A | 4/1982 | Lennington | |
| 4,408,157 | A | 10/1983 | Beaubien | |
| 4,420,398 | A | 12/1983 | Castino | |
| 5,087,883 | A | 2/1992 | Hoffman | |
| 5,101,326 | A | 3/1992 | Roney | |
| 5,111,606 | A | 5/1992 | Reynolds | |
| 5,264,997 | A | 11/1993 | Hutchisson et al. | |
| 5,407,799 | A | 4/1995 | Studier | |
| 5,410,519 | A | 4/1995 | Hall et al. | |
| 5,563,849 | A | 10/1996 | Hall et al. | |
| 5,890,794 | A | 4/1999 | Abtahi et al. | |
| 6,076,936 | A | 6/2000 | George | |
| 6,082,870 | A | 7/2000 | George | |
| 6,095,666 | A | 8/2000 | Salam | |
| 6,221,095 | B1 | 4/2001 | Van Zuylen et al. | |
| 6,244,728 | B1 | 6/2001 | Cote et al. | |
| 6,250,774 | B1 * | 6/2001 | Begemann et al. | 362/231 |
| 6,252,254 | B1 | 6/2001 | Soules et al. | |
| 6,292,901 | B1 | 9/2001 | Lys et al. | |
| 6,335,538 | B1 | 1/2002 | Prutchi et al. | |
| 6,348,766 | B1 | 2/2002 | Ohishi et al. | |
| 6,357,889 | B1 | 3/2002 | Duggal et al. | |
| 6,394,621 | B1 | 5/2002 | Hanewinkel | |
| 6,416,200 | B1 | 7/2002 | George | |
| 6,429,583 | B1 | 8/2002 | Levinson et al. | |
| 6,450,668 | B1 | 9/2002 | Kotloff | |
| 6,522,065 | B1 | 2/2003 | Srivastava et al. | |
| 6,590,220 | B1 | 7/2003 | Kalley et al. | |
| 6,598,994 | B1 | 7/2003 | Tait et al. | |
| 6,624,350 | B2 | 9/2003 | Nixon et al. | |
| 6,791,257 | B1 | 9/2004 | Sato et al. | |
| 6,874,911 | B2 | 4/2005 | Yoneda | |
| 6,880,954 | B2 | 4/2005 | Ollett et al. | |
| 7,086,756 | B2 | 8/2006 | Maxik | |
| 7,093,958 | B2 | 8/2006 | Coushaine | |
| 7,210,818 | B2 | 5/2007 | Luk et al. | |
| 7,213,940 | B1 | 5/2007 | Van De Ven et al. | |
| 7,350,955 | B2 | 4/2008 | Chang et al. | |
| 7,354,180 | B2 | 4/2008 | Sawhney et al. | |
| 7,614,759 | B2 | 11/2009 | Negley | |
| 7,625,103 | B2 | 12/2009 | Villard | |
| 7,648,257 | B2 | 1/2010 | Villard | |
| 7,665,862 | B2 | 2/2010 | Villard | |
| 7,718,991 | B2 | 5/2010 | Negley | |
| 7,722,220 | B2 | 5/2010 | Van De Ven | |
| 7,737,459 | B2 | 6/2010 | Edmond | |
| 7,744,243 | B2 | 6/2010 | Van De Ven | |
| 7,766,508 | B2 | 8/2010 | Villard et al. | |
| 7,768,192 | B2 | 8/2010 | Van De Ven | |
| 7,777,166 | B2 | 8/2010 | Roberts | |
| 7,824,070 | B2 | 11/2010 | Higley et al. | |
| 7,862,195 | B2 * | 1/2011 | Stack | A47F 3/001 362/125 |
| 8,025,428 | B2 * | 9/2011 | Duguay et al. | 362/311.02 |
| 8,118,450 | B2 | 2/2012 | Villard | |
| 8,408,739 | B2 | 4/2013 | Villard et al. | |
| 8,646,944 | B2 | 2/2014 | Villard | |
| 9,212,808 | B2 | 12/2015 | Higley et al. | |
| 2002/0006350 | A1 | 1/2002 | Nishida et al. | |
| 2002/0087532 | A1 | 7/2002 | Barritz et al. | |
| 2003/0057430 | A1 | 3/2003 | Rinaldi et al. | |
| 2003/0117798 | A1 | 6/2003 | Leysath | |
| 2004/0090794 | A1 | 5/2004 | Ollett et al. | |
| 2004/0105264 | A1 * | 6/2004 | Spero | 362/276 |
| 2004/0165379 | A1 | 8/2004 | Waters | |
| 2004/0212998 | A1 | 10/2004 | Mohacsi | |
| 2004/0252962 | A1 | 12/2004 | Ryan, Jr. | |
| 2005/0099478 | A1 | 5/2005 | Iwase | |
| 2005/0231948 | A1 | 10/2005 | Pohlert et al. | |
| 2005/0237739 | A1 | 10/2005 | Lee et al. | |
| 2005/0274972 | A1 | 12/2005 | Roth et al. | |
| 2005/0278998 | A1 | 12/2005 | Sawhney et al. | |
| 2006/0120073 | A1 | 6/2006 | Pickard et al. | |
| 2006/0138937 | A1 | 6/2006 | Ibbetson | |
| 2006/0248761 | A1 | 11/2006 | Cheung | |
| 2007/0137074 | A1 | 6/2007 | Van De Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0223219 | A1 | 9/2007 | Medendorp et al. | |
| 2007/0267983 | A1 | 11/2007 | Van De Ven | |
| 2007/0268707 | A1 | 11/2007 | Smester | |
| 2007/0274080 | A1 | 11/2007 | Negley | |
| 2007/0278503 | A1 | 12/2007 | Van De Ven | |
| 2007/0278934 | A1 | 12/2007 | Van De Ven | |
| 2007/0278974 | A1 | 12/2007 | Van De Ven | |
| 2007/0279440 | A1 | 12/2007 | Negley | |
| 2007/0280624 | A1 | 12/2007 | Negley | |
| 2008/0002399 | A1 | 1/2008 | Villard et al. | |
| 2008/0084685 | A1 | 4/2008 | Van De Ven | |
| 2008/0084700 | A1 | 4/2008 | Van De Ven | |
| 2008/0084701 | A1 | 4/2008 | Van De Ven | |
| 2008/0089053 | A1 | 4/2008 | Negley | |
| 2008/0106895 | A1 | 5/2008 | Van De Ven | |
| 2008/0130265 | A1 | 6/2008 | Negley | |
| 2008/0130285 | A1 | 6/2008 | Negley | |
| 2008/0136313 | A1 | 6/2008 | Van De Ven | |
| 2008/0170396 | A1 | 7/2008 | Yuan | |
| 2008/0192493 | A1 | 8/2008 | Villard | |
| 2008/0231201 | A1 | 9/2008 | Higley | |
| 2008/0259589 | A1 | 10/2008 | Van De Ven | |
| 2008/0278928 | A1 | 11/2008 | Van De Ven | |
| 2008/0278940 | A1 | 11/2008 | Van De Ven | |
| 2008/0304260 | A1 | 12/2008 | Van De Ven | |
| 2008/0304261 | A1 | 12/2008 | Van De Ven | |
| 2009/0002986 | A1 | 1/2009 | Medendorp | |
| 2009/0161356 | A1 | 6/2009 | Negley | |
| 2009/0184616 | A1 | 7/2009 | Van De Ven | |
| 2009/0246895 | A1 | 10/2009 | You | |
| 2009/0323334 | A1 | 12/2009 | Roberts | |
| 2010/0214780 | A1 | 8/2010 | Villard | |
| 2010/0296289 | A1 | 11/2010 | Villard et al. | |
| 2011/0069488 | A1 | 3/2011 | Higley et al. | |
| 2012/0188757 | A1 | 7/2012 | Villard | |

FOREIGN PATENT DOCUMENTS

| | | |
|---|---|---|
| WO | WO98/43014 | 10/1998 |
| WO | WO00/34709 | 6/2000 |

OTHER PUBLICATIONS

Interview Summary for U.S. Appl. No. 12/911,204 dated Apr. 15, 2015.

Notice of Allowance for U.S. Appl. No. 12/911,204 dated May 5, 2015.

Narendran et al., "Solid-state lighting: failure analysis of white LEDs", Journal of Crystal Growth, vol. 268, Issues 1-4, Aug. 2004, Abstract.

Van de Ven et al., "Warm White Illumination with High CRI and High Efficacy by Combining 455 nm Excited Yellowish Phosphor LEDs and Red A1InGaP LEDs", First Internat'l Conf. on White LEDs and Solid State Lighting, Nov. 30, 2007.

Shimizu, "Development of High-Efficiency LED Downlight", First Internat'l Conf. on White LEDs and Solid State Lighting, Nov. 30, 2007.

PermLigt.com product advertisement sheet dated at least as early as 2005.

(56) References Cited

OTHER PUBLICATIONS

Press Release from LED Lighting Fixtures dated Jan. 26, 2006 entitled "LED Lighting Fixtures Creates 750 Lumen Recessed Light and Uses Only 16 Watts of Power".
Press Release from LED Lighting Fixtures dated Feb. 16, 2006 entitled "LED Lighting Fixtures, Inc. Announces Record Performance".
Press Release from LED Lighting Fixtures dated Apr. 24, 2006 entitled "LED Lighting Fixtures, Inc. achieves unprecedented gain in light output from new lumiaire".
Press Release from LED Lighting Fixtures dated May 30, 2006 entitled "LED Lighting Fixtures, Inc. Sets World Record at 80 Lumens per Watt for Warm White Fixture".
Press Release from LED Lighting Fixtures dated Feb. 7, 2007 entitled "LED Lighting Fixtures Announces its first LED-based Recessed Down Light".
Press Release from LED Lighting Fixtures dated May 4, 2007 entitled "LED Lighting Fixtures to Expand Product Line".
Press Release from LED Lighting Fixtures dated Nov. 28, 2007 entitled "New Lamp from LED Lighting Fixtures Shatters World Record for Energy Efficiency".
CSA International, "Test Data Report," Project No. 1786317, Report No. 1786317-1 (Apr. 2006).
Compound Semiconductors Online, "LED Lighting Fixtures, Inc. Sets World Record at 80 Lumens per Watt for Warm White", dated May 30, 2006, http://www.compound semi.com/documents/articles/cldoc?6802.html.
DOE SSL CALiPer Report, "Product Test Reference: CALiPER 07-31 Downlight Lamp", Date of testing Sep. 7 to Sep. 10, 2007.
DOE SSL CALiPer Report, "Product Test Reference: CALiPER 07-47 Downlight Lamp", Date of testing Sep. 7 to Sep. 10, 2007.
U.S. Department of Energy, "DOE Solid-State Lighting CALiPER Program, Summary of Results: Round 3 of Product Testing," Oct. 2007.
U.S. Department of Energy, "DOE Solid-State Lighting CALiPER Program, Summary of Results: Round 4 of Product Testing," Jan. 2008.
U.S. Department of Energy, "DOE Solid-State Lighting CALiPER Program, Summary of Results: Round 5 of Product Testing," May 2008.
OptoLED Lighting GmbH product sheets—at least as early as Apr. 2008.
International Search Report and Written Opinion for PCT/US06/48521 dated Feb. 7, 2008.
International Search Report and Written Opinion for PCT/US07/12706 dated Jul. 3, 2008.
Non-Final Office Action for U.S. Appl. No. 11/519,058 dated Aug. 14, 2008.
European Search Report for Appl. No. 06845870.2 dated Nov. 6, 2008.
Final Office Action for U.S. Appl. No. 11/519,058 dated Jan. 12, 2009.
Non-Final Office Action for U.S. Appl. No. 11/689,875 dated Feb. 17, 2009.
Non-Final Office Action for U.S. Appl. No. 11/689,614 dated Apr. 15, 2009.
Office Action for U.S. Appl. No. 11,613,692 dated May 14, 2009.
Advisory Action for U.S. Appl. No. 11/519,058 dated Jun. 18, 2009.
Non-Final Office Action for U.S. Appl. No. 11/519,058 dated Sep. 4, 2009.
Non-Final Office Action for U.S. Appl. No. 11/689,614 dated Jan. 12, 2010.
Notice of Allowance for U.S. Appl. No. 11/519,058 dated Mar. 19, 2010.
Non-Final Office Action for U.S. Appl. No. 12/911,204 dated Feb. 3, 2011.
Non-Final Office Action for U.S. Appl. No. 12/848,884 dated Apr. 6, 2011.
Non-Final Office Action for U.S. Appl. No. 12/710,079 dated Mar. 16, 2011.
Final Office Action for U.S. Appl. No. 12/848,884 dated Sep. 22, 2011.
Notice of Allowance for U.S. Appl. No. 12/710,079 dated Oct. 14, 2011.
Final Office Action for U.S. Appl. No. 12/911,204 dated Jan. 5, 2012.
Non-Final Office Action for U.S. Appl. No. 12/848,884 dated Apr. 20, 2012.
Non-Final Office Action for U.S. Appl. No. 12/911,204 dated Aug. 20, 2012.
Final Office Action for U.S. Appl. No. 12/848,884 dated Sep. 14, 2012.
Notice of Allowance for U.S. Appl. No. 12/848,884 dated Nov. 30, 2012.
Restriction Requirement for U.S. Appl. No. 13/371,214 dated Mar. 7, 2013.
Final Office Action for U.S. Appl. No. 12/911,204 dated May 31, 2013.
Notice of Allowance for U.S. Appl. No. 13/371,214 dated Jul. 19, 2013.
Non-Final Office Action for U.S. Appl. No. 12/911,204 dated Sep. 24, 2013.
Non-Final Office Action for U.S. Appl. No. 12/911,204 dated Jul. 1, 2014.

* cited by examiner

TYPE I

TYPE I - 4-WAY

TYPE II

TYPE II - 4-WAY

TYPE III

TYPE IV

TYPE V

FIG. 5A
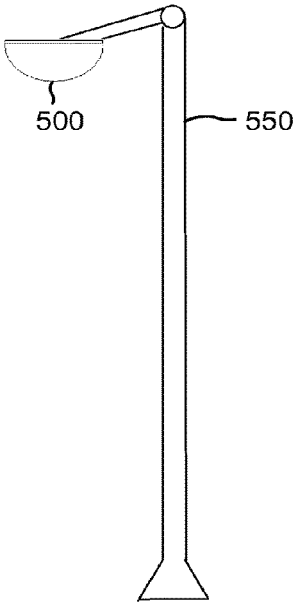
FIG. 5B
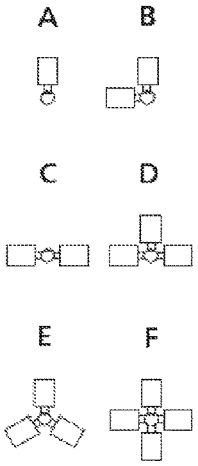
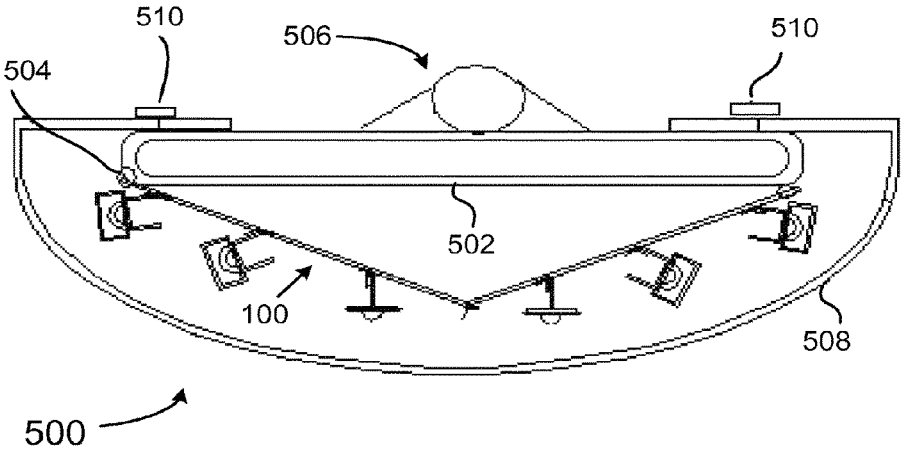
FIG. 5C

LED LIGHTING FIXTURE

CROSS-REFERENCE TO RELATED APPLICATIONS

This application is a continuation of and claims priority benefit to co-pending U.S. application Ser. No. 13/371,214 filed Feb. 10, 2012, which was a continuation of U.S. application Ser. No. 12/710,079, filed Feb. 22, 2010, which was a continuation of U.S. Pat. No. 7,665,862, filed Mar. 22, 2007, which was a continuation-in-part of U.S. Pat. No. 7,766,508, filed Sep. 12, 2006. The entire contents of each of these applications are incorporated by reference herein.

TECHNICAL FIELD

Example embodiments of the present invention in general relate to a light emitting diode (LED) lighting fixture.

DESCRIPTION OF THE RELATED ART

LEDs are widely used in consumer lighting applications. In consumer applications, one or more LED dies (or chips) are mounted within a LED package or on an LED module, which may make up part of a LED lighting fixture which includes one or more power supplies to power the LEDs. Various implementations of the LED lighting fixtures are available in the marketplace to fill a wide range of applications, such as area lighting (roadway and/or parking lot illumination) indoor lighting, backlighting for consumer electronics, etc.

Conventional area lighting such as roadway lights uses high pressure sodium (HPS) bulbs which provide omni-directional light. Reflectors are used to direct some of this light, but much of the light is lost illuminating unintended spaces. For example with HPS bulbs, the typical lumen amount will be in the tens of thousands of lumens, but all of that output does not illuminate the intended area, such as a roadway area for example.

LEDs offer improved light efficiency, a longer lifetime, lower energy consumption and reduced maintenance costs, as compared to HPS light sources. Conventional HPS bulbs are susceptible to maintenance loss and surface, dirt and other losses. Conventionally, area lighting fixtures used for roadway illumination are attached on poles and include omni-directional HPS bulbs with reflectors to illuminate the roadway in different patterns based on different situations.

FIGS. 1A to 1G show types of roadway illumination. As shown in FIGS. 1A to 1G, there are five primary types of roadway illumination. The Illuminating Engineering Society of North America (IESNA) is the recognized technical authority on illumination and puts out specifications for the five primary types of roadway illumination.

Type I illumination is a direct illumination in two directions along the direction of the roadway (if the road is a single road) and/or in a straight directional pattern at a cross section as shown in FIG. 1B. FIG. 1C illustrates a Type II pattern and shows a lighting fixture which directs light at an angle to normal in either two directions, or in four directions as shown in FIG. 1D.

Type III illumination in FIG. 1E shows a different angled illumination from normal as compared to Type II in FIG. 1C, where the angle of illumination from normal is narrower to reflect a smaller coverage area. Type IV illumination (FIG. 1F) has an even narrower angle of illumination from normal to create a different, smaller illumination area than either Type II or Type III. The omni-directional lighting pattern across the entire intersection which characterizes Type V illumination is shown in FIG. 1G.

Conventional HPS lighting fixtures must be replaced with a completely different fixture to change the lighting pattern at a given location. In order to change the shape and brightness of light output from a given HPS fixture, there is no way to adjust the pattern other than replacing the entire fixture. Similarly for LED lighting fixtures mounted on poles for area lighting applications, to change the shape and brightness, the entire fixture typically must be replaced.

SUMMARY

An example embodiment is directed to an LED lighting fixture that includes a support plate having a first surface and a second surface, a plurality of panels connected to the first surface, in which each panel has an array of LEDs mounted to a planar surface thereof, and a power supply provided on the second surface of the support plate for driving the LED arrays. At least one of the panels is fixed at an angle from one of a vertical or horizontal plane bisecting the support plate.

Another example embodiment is directed to an LED lighting fixture that includes a support plate, and a plurality of panels connected to the support plate. Each panel has an array of LEDs mounted to a planar surface thereof, and each of the panels is rotatable in at least two dimensions.

Another example embodiment is directed to an LED lighting fixture that includes a support plate, a first pair of front panels, and a second pair of rear panels. Each of the front and rear panels is connected to the support plate and has an array of LEDs mounted to a planar surface thereof. One or more of the front and rear panels are individually adjustable to create a desired illumination pattern. The fixture includes a power supply attached to the support plate for driving the LED arrays.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments.

FIG. 5A is perspective view of a lighting assembly mounted on a streetlight pole in accordance with an example embodiment.

FIG. 5B illustrates overhead views of example lighting assembly configurations on a streetlight pole.

FIG. 5C is a front view illustrating the LED lighting assembly of FIG. 5A in more detail.

DETAILED DESCRIPTION OF EXAMPLE EMBODIMENTS

Figure 1A:
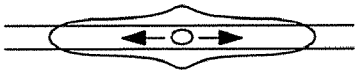
FIGS. 1A-1G show types of roadway illumination.
Figure 1B:
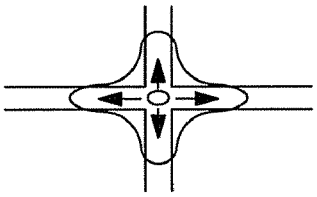
Figure 1C:
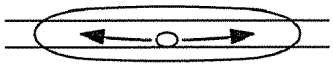
Figure 1D:
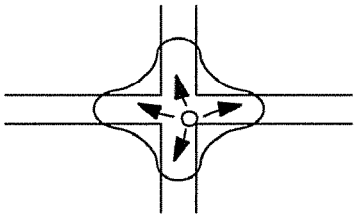
Figure 1E:
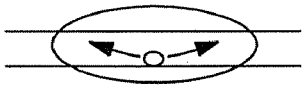
Figure 1F:
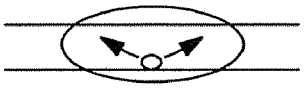
Figure 1G:
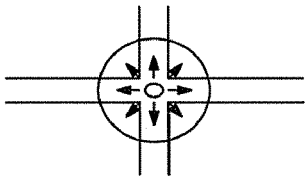

Example embodiments illustrating various aspects of the present invention will now be described with reference to the figures. As illustrated in the figures, sizes of structures and/or portions of structures may be exaggerated relative to other structures or portions for illustrative purposes only and thus are provided merely to illustrate general structures in accordance with the example embodiments of the present invention.

Furthermore, various aspects of the example embodiments may be described with reference to a structure or a portion being formed on other structures, portions, or both. For example, a reference to a structure being formed "on" or "above" another structure or portion contemplates that additional structures, portions or both may intervene there between. References to a structure or a portion being formed "on" another structure or portion without an intervening structure or portion may be described herein as being formed "directly on" the structure or portion.

Additionally, relative terms such as "on" or "above" are used to describe one structure's or portion's relationship to another structure or portion as illustrated in the figures. Further, relative terms such as "on" or "above" are intended to encompass different orientations of the device in addition to the orientation depicted in the figures. For example, if a fixture or assembly in the figures is turned over, a structure or portion described as "above" other structures or portions would be oriented "below" the other structures or portions. Likewise, if a fixture or assembly in the figures is rotated along an axis, a structure or portion described as "above" other structures or portions would be oriented "next to", "left of" or "right of" the other structures or portions. An example embodiment is directed to a LED lighting fixture, in which the shape of emitted light from the fixture may be defined by determining or selecting mounting angles of individual LEDs (also known as LED lamps), or mounting angles of an array or group of LEDs affixed on a metal LED strip, or multiple mounting angles to be set for multiple strips of LEDs, attached to a planar surface of adjustable metal panels of the fixture. As will be seen below, in some examples the mounting angles of individual LEDs and/or LED arrays or groups of LEDs on the strips are variable (i.e., adjustable within the fixture). This enables an end user to tailor the shape and direction of emitted light depending on an intended use. In other examples, the mounting angles of individual LEDs or LED strips on the panels, or angles that a panel is angled from a horizontal plane of the fixture is fixed or determined in advance from testing and adjustment to meet a particular application. Once the desired configuration is achieved, the lighting fixture may then be manufactured to specifications (e.g., reproduced and designed in a suitable mount and housing for installation on a particular mounting structure such as a light pole) such that these angles are fixed, and hence are not adjustable by an end user of the fixture.

Accordingly, in one example the angle of a given panel from the horizontal plane of the fixture may be set so as to achieve a desired illumination pattern. The angle that a panel is set from the horizontal plane influences the shape or direction of light emitted from the LEDs strips or groups of LEDs thereon. Additionally, the mounting angles of LED strips as determined from the planar surface of its corresponding panel may be set so as to achieve a desired illumination pattern. The mounting angle influences the shape or direction of light emitted from a line, column, group or array of LEDs that are mounted on the strip.

Further, the shape of emitted light from the fixture may be influenced or defined by the use of optical elements such as reflectors and/or secondary optics on some or all of the LED lamps. An optical element such as secondary optic modifies the pattern and/or direction of emitted LED light into shapes such as ovals, circles, etc. depending on the type of secondary optic.

Additionally as will be seen in further detail below one or more LEDs, such as an array, a line or a group of LEDs may be arranged on a plurality of strips which are mounted on a panel. The strips may be mounted on the panel so that two or more LEDs on the same or different strips are angled relative to each other. In one example the panel has a planar surface, with two or more of the LED strips set at different angles from each other, relative to the panel planar surface. In an alternative example, the panel has a curved surface. On the curved surface, LEDs of a given strip or group are at different angles from each other, relative to each other on the curved surface of the panel.

In one example, the LED lighting fixture described herein may be applicable to area lighting applications such as roadway street lights, parking lot and/or security lighting. For these applications, a LED fixture having a high powered lumen output is desired, with the LED fixture configured to output a total lumen count in the downward direction of at least 5,000 lumens, and a total output from the fixture of at least 6,000 lumens. However, the example embodiments may be useable in other applications for lighting such as within an office building, a home or a park, or any place where it is desired to use most or all of the light output to illuminate an intended area, and not just a general area of interest.

The example LED lighting fixture may thus be mounted on a suitable structure above the area of interest, and is configured to achieve or simulate a desired illumination pattern. The desired illumination pattern can be achieved or simulated (a) based on a determination or selection of the mounting angles for individual LEDs or LED strips on a given panel of the fixture; and/or (b) based on the determination or selection of the angle from horizontal that is set for one or more panel(s) of the fixture; and/or (c) based on the determination or selection of optical elements, such as secondary optics and/or reflectors, to be fitted on one or more LEDs, or on LED arrays or groups of LEDs of a given strip that is affixed to the panel(s). Based on the examples to be described below, LED fixtures may be configured in accordance with one or more of (a) through (c) above to achieve a total lumen count in the downward direction of at least 7000 lumens and a total lumen count for the fixture exceeding 10,000 lumens. These lumen values are comparable to conventional 100 to 150 W HPS bulbs used in streetlights.

Roadway lights may be located greater than 11 feet above a roadway, typically 20-40 feet above a roadway and may be classified as any of Type I, II, III, IV or V, according to the shape of the light output. Therefore, the example LED lighting fixture may be configured to achieve to desired illumination and/or light output to satisfy any of these Type I, II, Ill, IV or V roadway illumination patterns, by adjustment of one or more of (a) through (c) above.

Figure 2A:
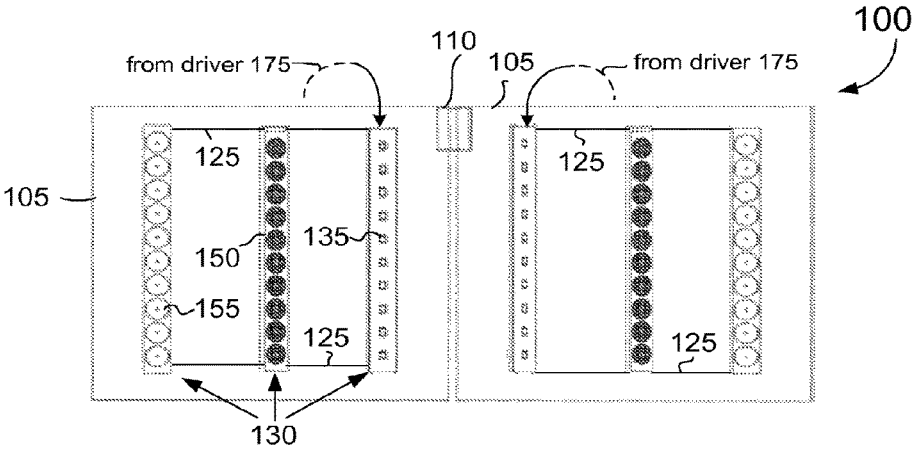
FIG. 2A is a bottom view of a LED lighting fixture in accordance with an example embodiment.

FIG. 2A is a bottom view of a LED lighting fixture in accordance with an example embodiment. In FIG. 2A there is shown a bottom view of LED lighting 100 which, when mounted on a streetlight pole would be facing downward to illuminate a roadway or area below the streetlight. The fixture 100 includes a pair of panels 105 which are connected to a hinge 110 there between. The hinge 110 permits either panel to be adjusted at an angle to a horizontal plane of the fixture 100. Each panel 105 may be embodied as a metal plate of a given thickness. As an example, the panels 105 may be of ½" thick lightweight aluminum honeycomb panels such as those fabricated by McMASTER-CARR.

Each panel 105 includes a plurality of LED strips 130 thereon. Each of the LED strips 130 may include an array, group or line of LEDs arranged in series along the longitudinal direction of the strip 130 across the panel 105, as shown in FIG. 2A. In the example of FIG. 2A, six LED strips are shown, each including an array of ten (10) LEDs 135 thereon, for a total of 60 LEDs. The LEDs 135 may be arranged on metal PCB (MPCB) strips having dimensions about 1.times.10 inches, for example. However, different configurations of LED arrays or groups or numbers of LEDs may be employed as would be evident to one of ordinary skill in the art.

The LEDs 135 may be made of any suitable color such as blue LEDs, green LEDs, red LEDs, different color temperature white LEDs such as warm white or cool or soft white LEDs. In an example, white light is typically used for area lighting such as street lights. White LEDs may include a blue LED chip and phosphor for wavelength conversion.

Certain LEDs 135 may be fitted with a secondary optic that shapes the light output in a desired shape, such as circle, ellipse, trapezoid or other pattern. As shown in FIG. 2A, there are illustrated two different optics 150 and 155, which are fitted to the LEDs on the center and outside LED strips 130. As will be explained in more detail below, the mounting angles of the LED strips 130 may be adjusted or fixed at the same or different angles with regard to a surface of the panel 105.

Each panel 105 may include a power supply for driving the LEDs 135 on the LED strips 130. The power supplies may be constant current drivers 175 which supply constant but adjustable current with variable voltage, depending on the number of LEDs 135. For example, a suitable power supply may be a switch mode, switching LP 1090 series power supply manufactured by MAGTECH, such as the MAGTECH LP 1090-XXYZ-E series switchmode LED driver, for example. The driver has an adjustable voltage range and the type of driver depends on the voltage drop of each of the LEDs in series in the LED matrix.

Each line of ten LEDs is electrically connected in parallel to its adjacent column or line over wires 125 and may be equally spaced as measured in the horizontal direction from the center of adjacent LEDs 135. In the vertical direction, the LEDs 135 may also be equally spaced, for example.

Figure 2B:
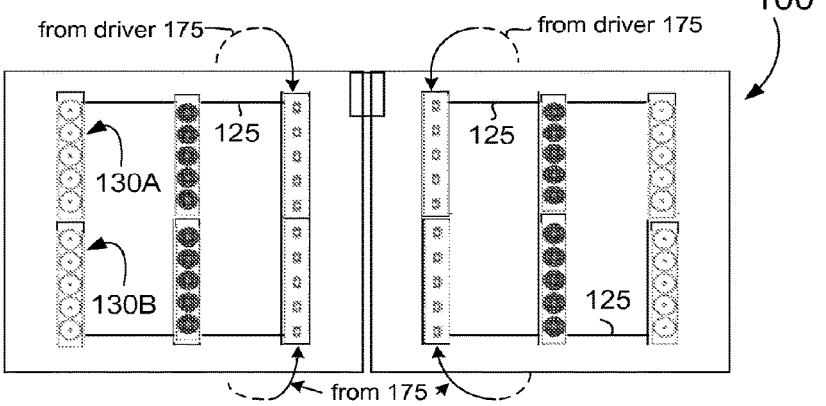
FIG. 2B is a bottom view of a LED lighting fixture in accordance with another example embodiment.

FIG. 2B is similar to FIG. 2A; however, in FIG. 2B the LED arrays or groups are broken up into strips 130A and 130B, each strip including a line, array or group of five LEDS 135. It should be understood that the example shown in FIGS. 2A and 2B are merely exemplary and that other array or group configurations of LEDs 135 may be provided on the panels 105.

Figure 2C:
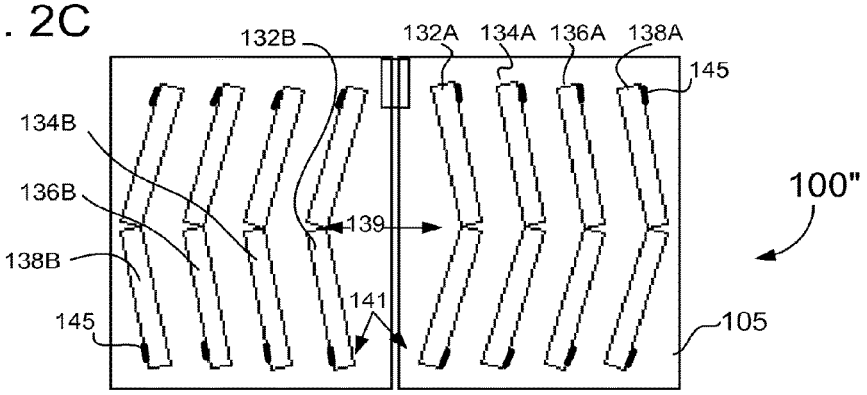
FIG. 2C is a bottom view of a LED lighting fixture in accordance with further example embodiment.

FIG. 2C is a bottom view of a LED lighting fixture in accordance with another example embodiment. The wires 125, LEDs 135, specific optics 150/155 and references to drivers 175 are not shown in FIG. 2C for clarity, it being understood that the wires 125, LEDs 135 and drivers 175 are included in fixture 100", and that different optics 150, 155 may be used for individual LEDs or strips of LEDs. Thus, the elements in FIG. 2C are similar to elements shown in FIGS. 2A and 2B, but with some minor differences.

As in FIG. 2B, the LED arrays or groups may be broken up into strips of five (5) LEDs 135 (LEDs not shown for clarity). In FIG. 2C, there are shown sixteen (16) LED strips of 5 LEDs each, for a total of 80 LEDs. However, FIG. 2C could be modified to accommodate different numbers of LED strips as shown in FIG. 2A or 2B, for example.

The LED strips in FIG. 2C are labeled in top-bottom pairs as LED strips 132A and 132B, LED strips 134A/B, LED strips 136A/B and LED strips 138A/B. Each of the strips 132A/B to 136A/B may have the same or different optics thereon, and one or more LEDs and/or one or more LED strips may have no optics thereon.

FIG. 2C also illustrates possible placements of hinges 145 on panel 105 to connect the strips 132A/B, 134A/B, 136A/B and 138A/B to the panel 105. This is only one example of hinge 145 placement. The hinges 145 permit its corresponding LED strip with LEDs thereon to be aimed so as to provide the desired illumination to certain areas below the fixture 100" such as on a street. Accordingly, different LED strips may be oriented at different mounting angles, so as to achieve a desired illumination pattern.

In FIG. 2C, each of the strips 132A/B to 138A/B may be angled outward from the panel surface in a vertical plane bisecting the panels 105 at the midpoints of the panel 105, either at the same or different angles. In this arrangement, the ends 139 of the strips may meet at an "apex" at the midpoint of the panel 105. For example, each strip 132A/B to 138A/B may be angled outward in a vertical plane from the planar surface of the panel 105 so that the ends 141 of the strips attached to the hinge 145 make a 20 degree angle from the panel surface, with the ends 139 at the midpoint meeting at an apex. Ends 139 may be fixedly attached to each other at the midpoint of the panel with suitable fastening means. This 20 degree angle is merely exemplary; other angles are possible.

The angling of the strips 132A/B to 138A/B from the vertical plane bisecting the panels 105 may act to increase the width of the illumination pattern made by a given strip. Moreover, as in FIGS. 2A and 2B, the hinge 110 in FIG. 2C permits either panel 105 in FIG. 2C to be adjusted at an angle to a horizontal plane of the fixture 100", which also varies the angles of individual strips 132A/B to 138A/B thereon.

Therefore, FIG. 2C illustrates a fixture in which mounting angles of LEDs or strips of LEDs may be varied in one or both the vertical and horizontal planes of the fixture 100" (two dimensions). By additionally varying the angles between the panels 105 and using the same or different optics on one or more LEDs or strips of LEDs, a desired illumination pattern or beam may be created which is comparable to existing patterns, such as the Type I-V roadway illumination patterns.

Figure 3A:
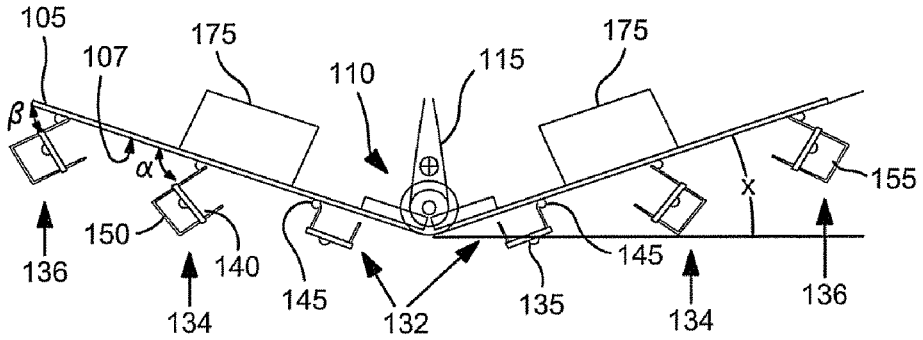
FIG. 3A is a front view of a LED lighting fixture in accordance with an example embodiment.

FIG. 3A is a front view of a LED lighting fixture in accordance with an example embodiment. In FIG. 3A, the fixture may be a lighting fixture 100/100' such as is shown in FIGS. 2A and 2B, for example. The wires 125 have been removed for purposes of clarity. In this front view, the LED strips 130 are shown in an end-on view. The drivers 175 are illustrated on the top side of panels 105. The locking hinge 110 may adjustable via a handle 115 attached thereto to change the angle of the panels with respect to the horizontal plane. As shown in FIG. 3A, each panel is adjusted at angle X from the horizontal.

For clarity, the LED strips 130 in FIG. 3A are labeled as interior LED strips 132, center LED strips 134 and outer LED strips 136. Each line of LEDs 135 may be mounted on a printed circuit board such as a metal core printed circuit board (MCPCB, not shown) along the longitudinal direction of each strip 132, 134, 136. The LED strips 132, 134, 136 may be affixed to a metal bar 140, which in this configuration is shown as an inverted U-bar 140.

Accordingly, a given LED strip includes the U-bar 140 with an array or group of LEDs 135 mounted thereon, and electrically connected to the drivers 175 via the wires 125 (not shown) and the MCPCB. Additionally as shown in FIG. 3A, a leg of each U-bar 140 is attached to a planar surface 107 of its corresponding plate 105 by a hinge 145. This permits the LED strips 132, 134 and 136 to be angled or adjusted to a desired mounting angle from the surface 107 of the panel 105. As can be seen in FIG. 3A, the mounting angle is an angle along a horizontal plane of the fixture 100, such as the angle from horizontal along the planar surface 107 of the panel 105. Different LED strips may be oriented at different mounting angles, as shown by the angles .alpha. and .beta. in FIG. 3A (.alpha.noteq.beta.) so as to achieve a desired illumination pattern. Therefore, the fixture 100 may be configured to simulate or replicate a particular illumination pattern by adjusting (a) the panel or hinge angle from horizontal (angle X), and/or (b) the mounting angles of individual LED strips 132, 134 136 and/or (c) through the use of optics (such as optics 150 and 155) on individual LEDs 135 of strips 132, 134, 136.

Figure 3B:
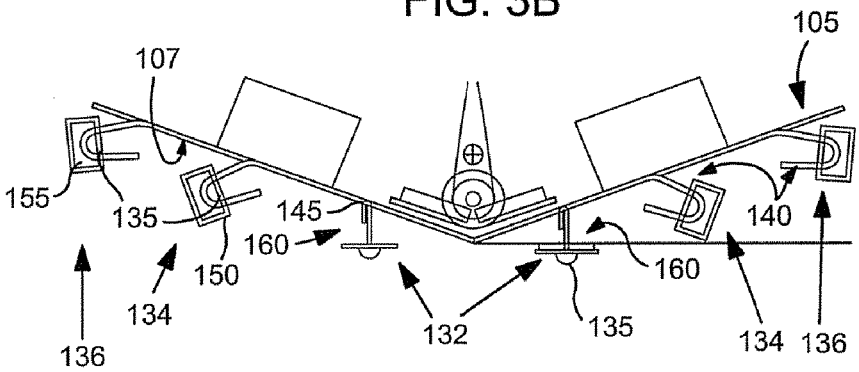
FIG. 3B is front view of a LED lighting fixture in accordance with another example embodiment.

FIG. 3B is similar to FIG. 3A and may be a lighting fixture 100/100' such as is shown in FIGS. 2A and 2B, for example. However, in FIG. 3B, T-bars 160 may be used for mounting the LED strips thereon instead of or in conjunction with U-bars 140. Each leg of the T-bar 160 is affixed to the surface 107 of its corresponding panel 105 via a hinge 145, as illustrated in FIG. 3A. It will be evident to one of ordinary skill in the art that different combinations of T-bars and U-bars supporting the corresponding LED strips 132, 134, 136 may be utilized on the panel 105 of fixture 100.

Figure 3C:
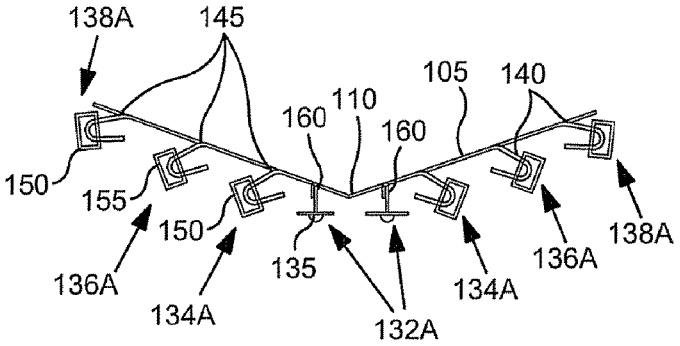
FIG. 3C is front view of the LED lighting fixture in FIG. 2C in accordance with another example embodiment.

FIG. 3C is front view of the LED lighting fixture 100" shown in FIG. 2C, to illustrate the use of different optics, multiple angles, and different bar configurations supporting the LEDs 135. FIG. 3C is similar to FIGS. 3A and 3B, but for purposes of clarity does not show the locking hinge 110, handle 115, wires 125 and drivers 175, it being understood that these are included in fixture 100".

FIG. 3C shows a front, end-on view of the top strips 132A, 134A, 136A and 138A in the bottom view of FIG. 2C, it being understood that the view would be similar for LED strips 132B, 134B, 136B and 138B. FIG. 3C does not illustrate the elevated angle of each strip 132A, 134A, 136A and 138A in the vertical plane from the surface 107 of each panel 105, it being understood that these strips are angled vertically outward at a given angle (such as 20 degrees) from the surfaces 107 of panels 105 as shown in FIG. 2C. As previously described in FIG. 2C, the ends 139 of these strips 132A, 134A, 136A and 138A at the panel 105 midpoint meet the ends 139 of strips 132B, 134B, 136B and 138B at the panel 105 midpoint to form an apex between each set of strips 132A/B, 134A/B, 136A/B and 138A/B.

In addition to the vertical angles of each of the strips, the mounting angles of individual LED strips 132A, 134A, 136A and 138A in FIG. 3C may be different, and different LEDs or LED strips may employ the same or different optics (such as optics 150, and 155) on individual LEDs 135. In FIG. 3C, LED strips 132A are mounted on T-bars, with strips 134A, 136A and 138A being mounted on U-bars 140. The configuration would be mirrored for LED strips 132B, 134B, 136B and 138B.

However, in another example, T-bars 160 alone may be used for mounting all strips thereon, to permit the ability to move the strip in both directions. The single legs of the T-bars 160 and one "outer" leg of each U-bar 140 is affixed to the surface 107 of its corresponding panel 105 via a hinge 145, as illustrated in FIG. 3C.

As an example, the mounting angles may be set as desired to simulate a typical roadway illumination pattern as shown in FIGS. 1A-1G. In a particular example, in FIG. 3C the fixture 100" may be configured to create a beam comparable to a Type II roadway lamp.

In FIG. 3C, the hinge angle of the panel is shown at a negative 20 degrees from horizontal. For assimilating a Type II roadway pattern, the strips 132A (and 132B of FIG. 2C, not shown) may have no optics and have a 75 degree viewing angle to generate a 75 degree beam directly below; with the hinge angle set at −20 this gives a total of 0 degree offset.

A medium viewing angle optic 150 may be used for strips 134A (and 134B, not shown). Strips 134A/B may be angled at a 35.degree. angle from the planar surface 107 of its corresponding panel 105. With its panel 105 at a −20 degree offset, this provides a total 55 degree angle that, in conjunction with the medium viewing angle optic 150, provides a 50.degree. viewing angle to generate a medium beam.

A spot optic 155 may be used for strips 136A (and 136B). Strips 136A/B with the spot optic 155 may be set at a 12 degree viewing angle, and the strips may be angled at 55 degrees from surface 107. With the negative 20 degree hinge angle, this provides a total angle of 75 degrees.

A circular optic 150 may be used for strips 138A (and 138B, not shown). Strips 138A/B with the circular optic 150 may be set at a 19 degree viewing angle, and the strips may be angled at 45 degrees from surface 107. With the negative 20 degree hinge angle, this provides a total angle of 65 degrees. These are only example mounting angles to simulate a given pattern, in this case a Type II medium lighting pattern, other settings may be used.

Figure 4A:
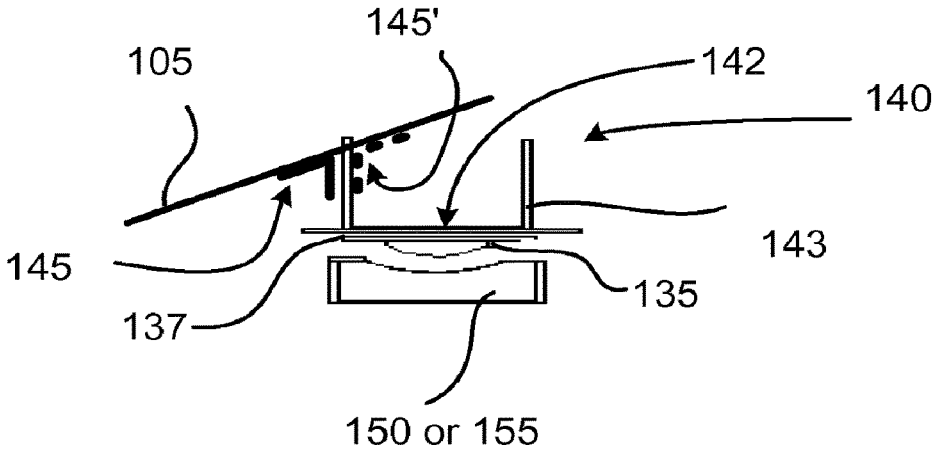
FIG. 4A is a detailed end view of the LED strip shown in FIGS. 2A and 2B in accordance with an example embodiment.

FIG. 4A is a detailed end view of the LED strip shown in FIGS. 2A and 2B in accordance with an example embodiment. FIG. 4A illustrates an enlarged view of a U-bar 140 with LED 135 and optic 150/155 mounted thereon. As can be seen in FIG. 4A, the U-bar includes a pair of legs 143 and a generally horizontal surface 142. The MCPCB 137 with LED 135 and optic 150/155 mounted thereon may be attached by a suitable epoxy to the horizontal surface 142 of the U-bar 140. One leg 143 of the U-bar 140 may be attached to the panel 105 via a suitable friction hinge 145. In a variant, a pair of friction hinges 145 and 145' may be provided on either side of leg 143. The legs 143 of U-bar 140 offer an additional benefit by providing a heat dissipation function to allow heat to dissipate from the LED 135 to the metal plate 105.

MCPCB 137 includes a positive voltage terminal and a negative voltage terminal (not shown). Where two MCPCBs 137 are used in a single column, as shown in FIG. 2B, the negative voltage terminal of one MCPCB 137 is electrically connected to the positive voltage terminal of the other MCPB 137 so that the ten LEDs defining a line, group or array of LEDs are electrically connected in series.

Figure 4B:
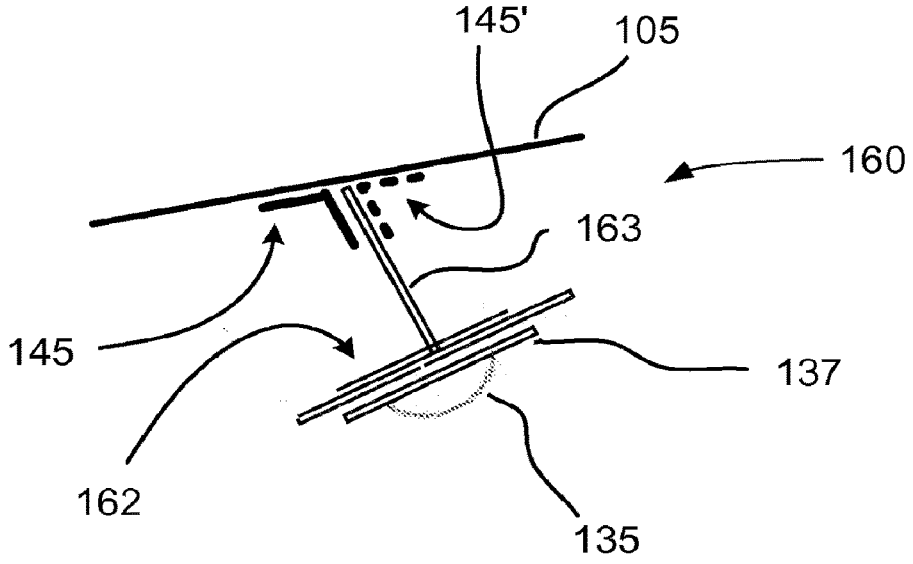
FIG. 4B is a detailed end view of the LED strip shown in FIGS. 2A and 2B in accordance with another example embodiment.

FIG. 4B is a detailed end view of the LED strip shown in FIGS. 2A and 2B in accordance with another example embodiment. FIG. 4B shows an enlarged view of the T-bar 160 shown in FIG. 3B. Similar to the U-bar 140 shown in FIG. 4A, a leg 163 of the T-bar may be attached to the panel 105 via a friction hinge 145, and/or may be attached via a pair of hinges on either side of the leg 163. The horizontal surface 162 of the T-bar supports the LED 135 thereon which is attached to the MCPCB 137. The MCPCB 137 in turn is attached to the horizontal surface 162 via suitable epoxy, for example. Although FIG. 4B shows an array or group of LEDs 135 without optics, the T-bar configuration may be used with LEDs 135 fitted with a given secondary for example.

FIG. 5A is a perspective view of a lighting assembly mounted on a streetlight pole in accordance with an example embodiment, and FIG. 5B illustrates overhead views of example lighting assembly configurations on a streetlight pole. Referring now to FIG. 5A, the LED lighting fixture 100 may be enclosed within a lighting assembly 500 for protecting the power supplies 175 from the environmental conditions. The lighting assembly 500 may be mounted to a streetlight pole 550 as shown in FIG. 5A and configuration A of FIG. 5B, or in one of the example configurations B-F shown in FIG. 5B. Other configurations are evident to one or ordinary skill in the art.

FIG. 5C is a front view illustrating the LED lighting assembly of FIG. 5A in more detail. As shown in FIG. 5C, the lighting fixture 100 is attached to a suitable backing plate 502 via a pair of locking slide brackets 504 to enable adjustments. The backing plate 502 may be made of a hollow aluminum or honeycomb aluminum cell structure, for example, as is known in the art. The backing plate 502 may be attached to a pole mount assembly 506 so that the lighting assembly 500 may be affixed to the street light pole 550. A suitable clear enclosure 508 may be attached to the backing plate 502 via locking clasps 510 so as to enclose and protect the lighting fixture 100 and drivers 175 (not shown in FIG. 5C for purposes of clarity) from environmental conditions. Enclosure 508 may be formed of a clear tough plastic material conventionally used for streetlight fixture covers, for example.

Figure 6:
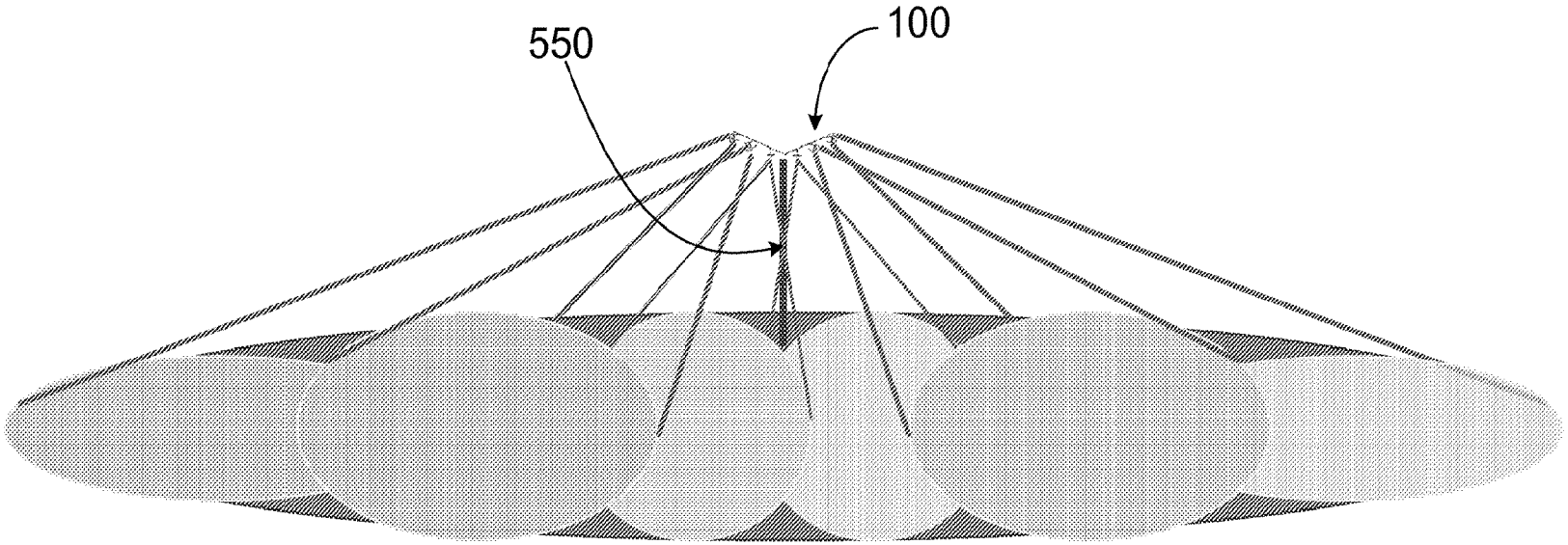
FIG. 6 illustrates an example LED lighting fixture mounted on a streetlight pole and configured to replicate a medium Type II roadway illumination pattern.

FIG. 6 illustrates an example LED lighting fixture mounted on a streetlight pole and configured to replicate a medium Type II roadway illumination pattern. For purposes of clarity, FIG. 6 illustrates the LED lighting fixture 100 mounted atop a streetlight pole 550 without showing the cover or additional components such as drivers 175, wiring etc. In FIG. 6, the embodiment of FIG. 3B is shown where the interior LED strips are mounted on T-bars, and where the angled U-bars support LED strips in the center and outside rows of the fixture 100.

FIG. 6 is provided to illustrate how the LED lighting fixture 100 may be configured to achieve a desired illumination, which as shown is a Type II medium roadway illumination pattern, using the principals of the present invention. Accordingly, one or more of the LED strips may be set at desired mounting angles from the surface 107 of the panels 105 as shown in FIG. 3B, and the individual panels 105 adjusted from a horizontal plane at a suitable hinge angle by the use of the hinge 110 in FIG. 3B. The combination of setting the hinge and mounting angles with the use of optics may enable the fixture 100 to achieve a desired illumination pattern.

Figure 7A:
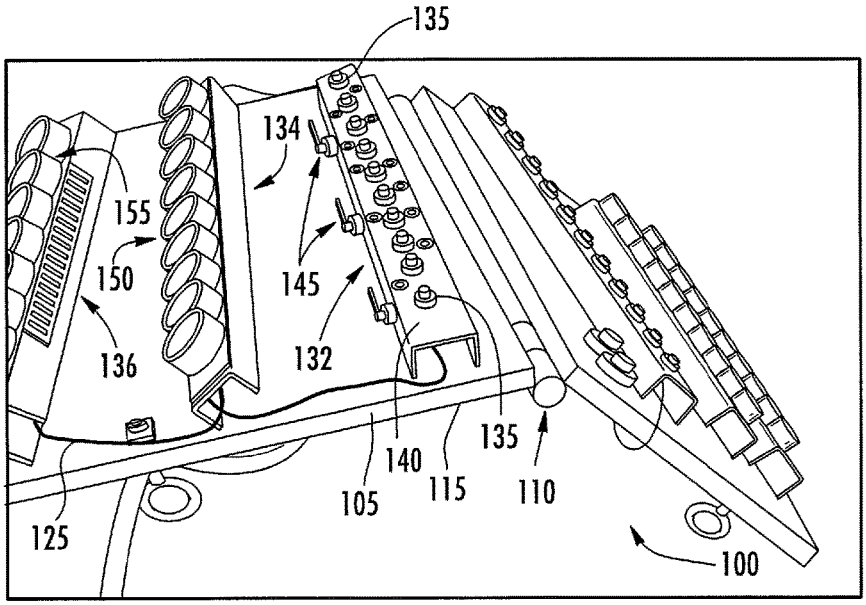
FIG. 7A is a photograph illustrating a bottom side view (inverted) of an example LED lighting fixture.
Figure 7B:
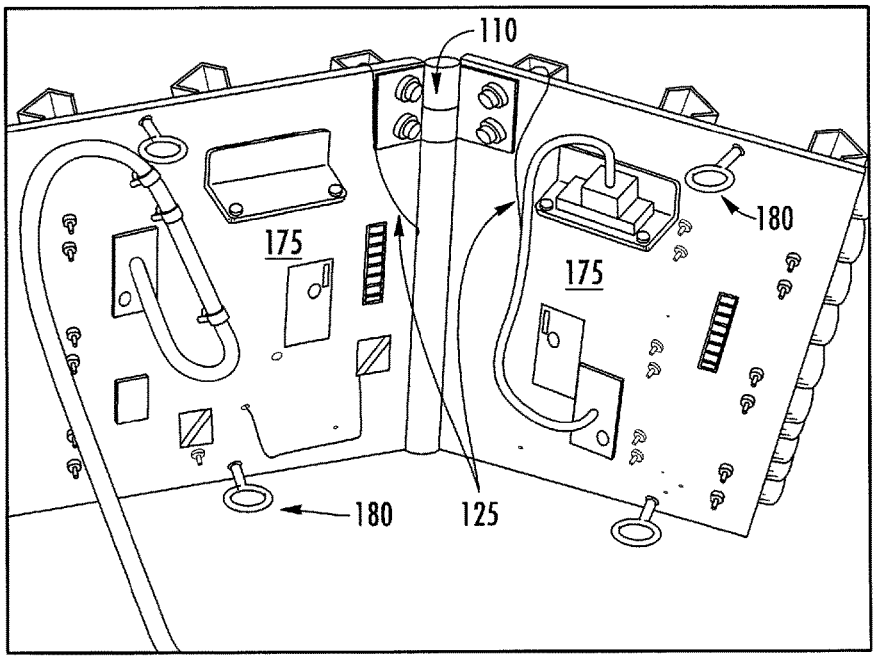
FIG. 7B is a photograph of the top side view of the fixture in FIG. 7A to illustrate the power supplies.

FIG. 7A is a photograph illustrating a bottom side view (inverted) of an example LED lighting fixture; FIG. 7B is a photograph of a top side view of the fixture of FIG. 7A to illustrate the power supplies. The fixture 100 shown in FIGS. 7A and 7B is a prototype built by and tested by the inventors, and for purposes of clarity is shown inverted from its actual orientation, which would be facing downward from a light pole to illuminate an area below. FIG. 7A thus illustrates additional detail of the embodiment shown in FIG. 2A, in which there are six LED strips in parallel (interior strips 132, center strips 134 and outer strips 136) for a total of sixty, 80 lumen, white LEDs on each panel 105. Each illustrated panel 105 is composed of 0.125" thick aluminum plates, 12".times.6". The panels 105 are set at a 20 degree offset angle from horizontal (or negative 20 degree hinge angle).

As shown more clearly in FIG. 7A, a given LED strip 130 includes a plurality of serially arranged LED lamps 135 (these are best seen without optics on LED strip 132) mounted on a U-bar 140. In this example, U-bar 140 is composed on 6061 aluminum. As described above in FIG. 4A, each U-bar 140 includes a horizontal mounting surface 142 and two extending legs 143 (not labeled; see FIG. 4A). The legs 143 provide an additional benefit as a source of heat dissipation from the serial array or group of LED lamps 135 thereon. Each of the LED strips 132, 134, 136 is affixed to its panel 105 by friction hinges 145 (best shown on strip 132) and is electrically connected in parallel via wires 125. The wires 125 are connected to the constant current drivers 175 on the top side of the fixture 100 (the side that would be facing skyward when mounted on a light pole) as shown in FIG. 7B for providing driving current to the LED lamps 135.

FIG. 7A further illustrates the principles of adjusting panel angle with respect to the horizontal plane, using variable mounting angles and using different optics for the LED lamps 135 in order to achieve a desired illumination pattern. The prototype illustrated in FIG. 7A was configured to create or replicate a medium Type II roadway illumination pattern, as shown in FIG. 6. Accordingly, the fixture 100 shown in FIG. 7A employed the principles of the invention to create a beam comparable to a Type II roadway lamp. For testing, the fixture 100 was mounted using eye bolts 180 into a position 20 feet above ground level in order to determine the desired mounting angles of the LED strips and/or the angle of the panels 105.

In this particular example, which is not limitative of the present invention and which may be modified to accommodate any desired illumination pattern, the interior strips 132 were flush mounted to the surface of the panels 105, and no optics were fitted on the array or group of LEDs 135 mounted on strips 132. Accordingly, in this configuration, the LED strips 132 have a 75.degree. viewing angle to generate a 50.degree. degree illumination pattern underneath the fixture 100, when the fixture 100 is mounted on a suitable support or street lamp post, for example.

Each LED lamp 135 on the center LED strips 134 includes a secondary optic 150. In this example, the optic 150 used on strips 134 was a round, medium viewing angle optic manufactured by CARCLO® Technical Plastics. However, the U-bar for strip 134 (on each panel 105) is fixed at a first angle from the planar surface of its panel 105. In this example, each LED strip 134 is angled at a 35.degree. angle from the planar surface of its corresponding panel 135. With its panel 105 at a 20 degree offset (or hinge 110 angle set at −20 degrees), this provides a total 55 degree angle which, in conjunction with the medium viewing angle optic, provides a 50.degree. viewing angle to generate a medium beam.

Outer strips 136 have an even different angle of inclination from the plane of the panel 105 to provide an even different viewing angle. In this example, the optic 155 employed was a CREE® 144E spot optic, which was fitted to each of the LED lamps 135 on strip 136. The U-bar was set at a 55.degree. angle from the planar surface of the panel 105, for a total angle of 75 degrees when combined with the −20 degree hinge angle of its panel 105. The combination of panel angle, mounting angle of strip 136 and spot optic 155 provided a 19.degree. viewing angle that generated a narrow, stronger spot beam in order to illuminate at a longer distance away from the fixture 100.

Therefore, different optics in different angles of the strips 130 as measured from the planar surface of the panels 105, coupled with the hinge angles set for the panels 105, may be used or selected in order to create a desired or intended illumination pattern, such as the Type II roadway illumination pattern shown in FIG. 6.

The prototype fixture 100 shown in FIGS. 7A and 7B—six arrays of 10 white LEDs each, was tested with a standard Graesby 211 calibrated photometer system (traceable to NIST) and performed using absolute photometry to evaluate flux distribution and area coverage in simulating a Type I roadway illumination pattern. The fixture 100 tested had electrical specifications set at 120 VAC, 1.259 A and 149.9 W. The fixture 100 achieved desirable horizontal illumination results in at least a 1.times.1 mounting height coverage area or greater on the ground below. The mounting height tested was 25 feet, although the mounting height could be set at a desired height between 11 and 40 feet above ground level for example. The flux distribution data from this test is set forth below in Table 1.

TABLE 1

Flux Distribution for Prototype Fixture -- TYPE I

| LUMENS | DOWNWARD | UPWARD | TOTAL |
|---|---|---|---|
| HOUSE SIDE | 2626 | 112 | 2738 |
| STREET SIDE | 3326 | 120 | 3447 |
| TOTALS | 5953 | 233 | 6186 |

Figure 8:
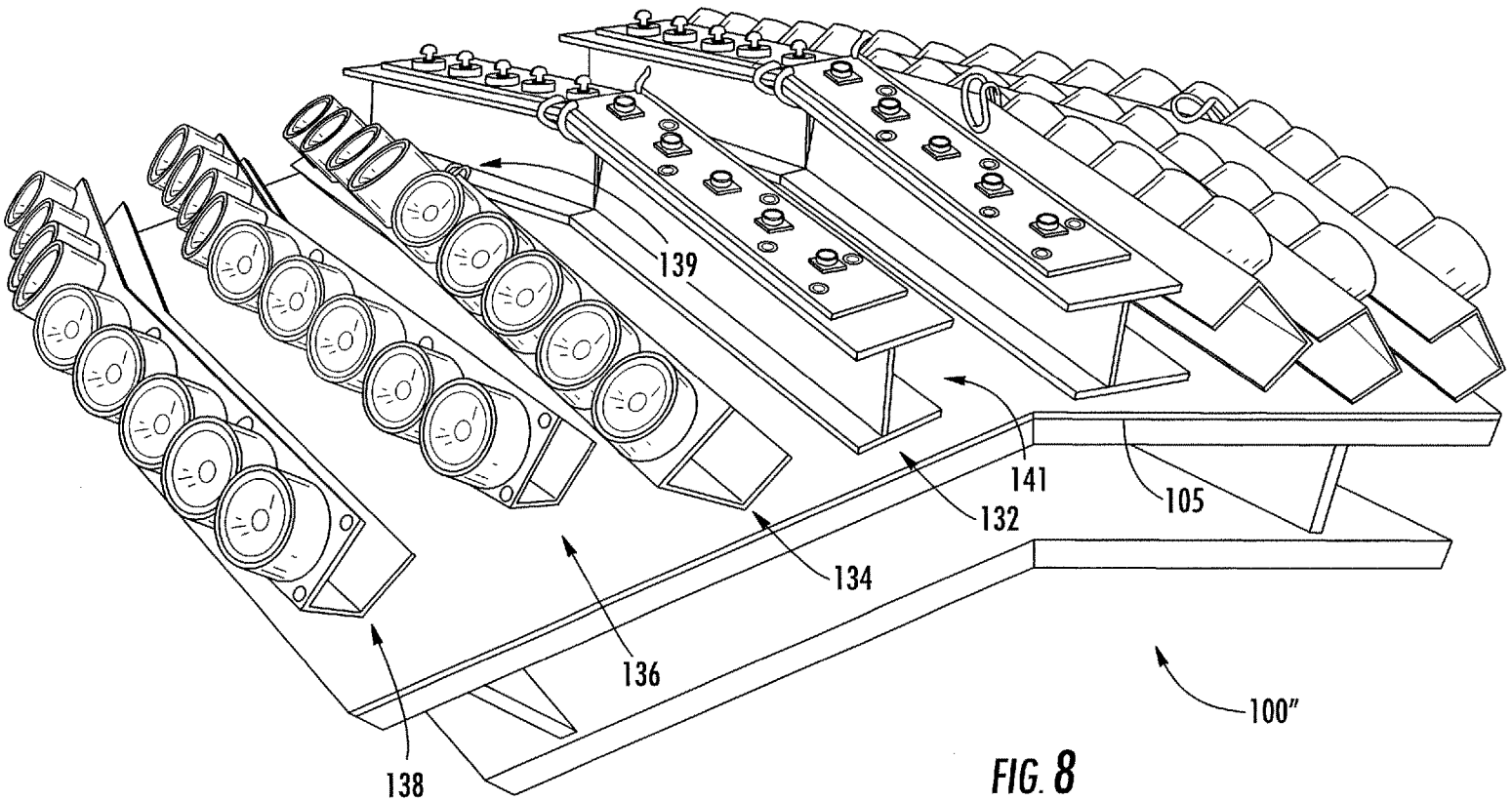
FIG. 8 is a photograph illustrating a bottom side view (inverted) of an LED lighting fixture based on FIGS. 2C and 3C.

FIG. 8 is a photograph illustrating a bottom side view (inverted) of another LED lighting fixture based on FIGS. 2C and 3C. The prototype illustrated in FIG. 8 was also configured to create or replicate a medium Type II roadway illumination pattern, as shown in FIG. 6. Accordingly, the fixture 100" shown in FIG. 8 employed the principles of the invention to create a beam comparable to a Type II roadway lamp.

The fixture 100" is shown inverted on a platform to better see the makeup of LED strips and secondary optics on the panel, as well as to highlight the various angles. The fixture 100" in FIG. 8 is based on that shown in FIGS. 2A and 3A. For purposes of clarity, LED strips in FIG. 8 are labeled 132, 134, 136 and 138, it being understood that these strips comprise strips 132A/B, 134A/B, 136A/B and 138A/B as shown in FIG. 2C, 3C.

FIG. 8 illustrates additional detail of the embodiment shown in FIG. 2C, in which there are 8 sets of 5-LED strips in parallel for a total of eighty, 80 lumen, white LEDs on a single panel 105. The panel 105 may be composed of 0.125" thick aluminum plates, 12".times.6" and formed at a 20 degree offset angle from horizontal.

One difference from FIG. 3C is that an L-bar instead of a U-bar was used for mounting strips 134A-B, its being understood that any combination of bars could be used as a mount for the LED strips, and adjusted to desired mounting angles on panel 105.

Another difference is that a single panel 105 was used, which is shown angled in its center from horizontal. Accordingly, a single panel 105 may be angled such as is shown in FIG. 8, in lieu of using a locking hinge 110 between multiple panels.

Unlike FIGS. 7A and 7B, for this prototype fixture 100" in FIG. 8, individual LEDs or LED strips have been angled in two dimensions. As described in FIG. 2C, in addition to the lateral angle(s) from the surface of panel 105, each of the strips may be angled outward from the panel surface in a vertical plane. As best shown in FIG. 8, the ends 139 of the strips 132 to may meet at an "apex" at the midpoint of the panel 105. In FIG. 8, one end 141 of each of the strips is attached to the hinge 145 (not labeled), and the other end is attached at a midpoint of panel 105 to its corresponding strip (i.e., 132A to 132B, etc.) so as to make a 20 degree angle from the panel surface.

Although not labeled for purposes of clarity, a hinge 145 may be provided at the midpoint between the two strips 132A/B in FIG. 8, for example, to vary the angle of each strip (such as strips 132A/B) in the vertical plane. The apex between each set of strips can be readily seen at the midpoint of panel 105 in FIG. 8. This arrangement therefore orients or angles the LED strips 132 to 138 in a second, vertical dimension. This angle can be varied by providing a hinge at the junction between the two strips.

The panel 105 is angled in the middle thereof. The angle of the panel 105 in FIG. 8 is at a negative 20 degrees from horizontal. LED strips 132 in FIG. 8 have no optics and have a 75 degree viewing angle to generate a 75 degree beam directly below; with the panel angle set at −20 from horizontal, this gives a total of 0 degree offset.

In this prototype, the optic used on strips 134 and 138 was a round, medium viewing angle optic manufactured by CARCLO® Technical Plastics. LED Strips 134 were angled at a 35.degree. angle from the planar surface of panel 105, for a total 55 degree angle that, in conjunction with the medium viewing angle optic 150, provides a 50.degree. viewing angle to generate a medium beam. Strips 138 employed the circular optic 150 set at a 19 degree viewing angle. LED strips 138 we set at 45 degrees from the surface of the panel. With the negative 20 degree panel angle from horizontal, this provides a total angle of 65 degrees.

Strips 136 have an even different angle of inclination from the plane of the panel 105 to provide an even different viewing angle. In this example, the optic 155 employed was a CREE® 144E spot optic, which was fitted to each of the LED lamps 135 on strips 136. The U-bar was set at a 55.degree. angle from the planar surface of the panel 105, for a total angle of 75 degrees when combined with the −20 degree hinge angle of its panel 105.

Therefore, the fixture 100" of FIG. 8 employs different optics, different mounting angles of the strips in two dimensions, and an angled panel from horizontal to create a desired or intended illumination pattern, such as the Type II roadway illumination pattern shown in FIG. 6.

Once a desired illumination pattern has been mechanically achieved due to the adjustment of the angles and the inclination of the U-bars 140 and/or angle of the panels 105, and/or due to the selection of optics on one, some or all of the LEDs on a given LED strip, the configuration may be reproduced with the adjustable strip mounting angle and panel angle features within a suitable waterproof housing (such as shown in FIGS. 5A-5C) and mounted to a streetlight pole or other support structure. Alternatively, once a given fixture 100 has been configured to achieve or replicate a desired illumination pattern, the optics' characteristics, LED strip mounting angles and hinge angle of the panels 105 can be recorded, and a LED lighting fixture with fixed angles and optic characteristics may be manufactured for specified lighting pattern application(s).

Figure 9A:
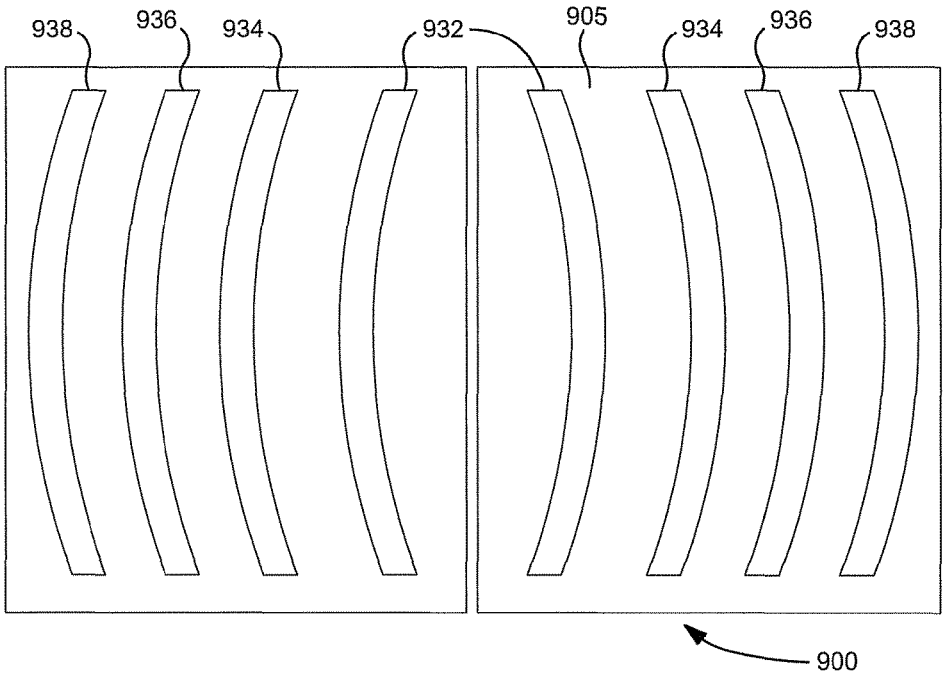
FIG. 9A is a bottom view of a LED lighting fixture in accordance with another example embodiment.
Figure 9B:
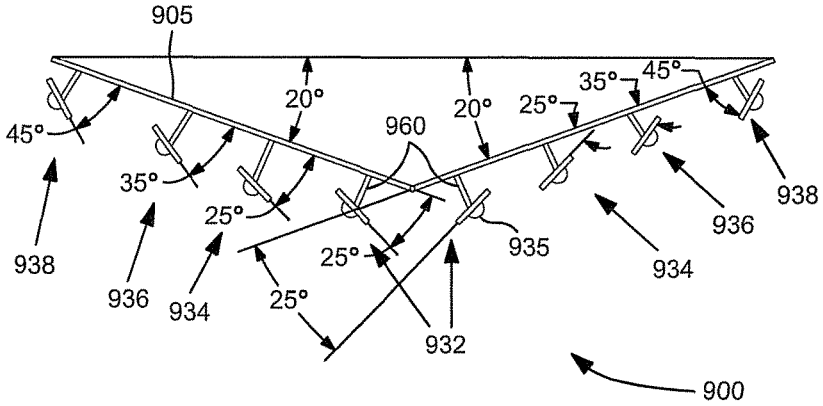
FIG. 9B is a front view of the LED lighting fixture of FIG. 9A.

FIG. 9A is a bottom view of a LED lighting fixture in accordance with another example embodiment; FIG. 9B is a front view of the LED lighting fixture of FIG. 9A. FIGS. 9A and 9B illustrate another fixture 900 that is configured to create a Type II roadway lighting pattern comparable to a 150 watt HPS cobra head lamp.

In the fixture 900 of FIG. 9A, the wires 125, LEDs 135 and references to drivers 175 are not shown for clarity, it being understood that the wires 125, LEDs 135 and drivers 175 are included in fixture 900. Further, the hinges 145 are not shown on each of LED strips 932, 934, 936, 938, it being understood that the bars of the LED strips may be attached to a panel 905 in a fixed relationship at some given angle to the panel surface 905 without hinges, or may be connected for variable movement to panel 905 via one or more hinges. In an example, the panels 905 may be of 0.125" thick lightweight aluminum honeycomb panels, dimension 12".times.6", such as those manufactured by McMASTER-CARR. Unlike previous embodiments, there is no secondary optics fitted on the LEDs of fixture 900.

The LED arrays or groups include eight (8) LED strips 932 to 938, four on each panel 905. Each LED strip 932, 934, 936, 938 includes a matrix of 10 LEDs (not shown) in series on MPCB strips having dimensions about 1.times.10 inches. Each LED may be a 80 lumen, white LED for example, although LEDs with an even higher lumen count could be used. Thus, there are eight strips in parallel for a total of 80 LEDs. However, FIG. 9A could be modified to accommodate a different number of LED strips, for example.

As will be seen in more detail in FIG. 9B, each of the strips 932 through 938 on each panel are angled from a horizontal surface of its corresponding panel 905. Additionally, each of the strips 932 to 938 is curved instead of straight. As shown in FIG. 9A, each bar of an LED strip is configured in an arc of 15 degrees at its center to expand the light pattern outwards. Additionally, the panels 905 are angled from horizontal at an angle of 20 degrees.

Referring to the front, end-on view of FIG. 9B, the panels are shown set at a 20 degree offset from horizontal (panel angle or hinge angle at −20 degrees from horizontal). A hinge is not shown, it being understood that the panels 905 in this example can be hinged at a given panel angle from horizontal, or fixed in place at a set panel angle, such as is shown in FIG. 8. In this example, none of the LEDs 935 is fitted with secondary optics, and each LED 935 has a 75 degree viewing angle. Each LED 935 is mounted on a MCPCB (not shown in FIG. 9B) which in turn is mounted on a longitudinally extending T-bar 960; only T-bars 960 are used in this embodiment. Each T-bar 960 is configured as shown in FIG. 4B, and can be fixed in place at a given angle to the surface of the panel 905, or connected to its panel 905 at an angle that can be varied by a suitable hinge connecting the leg of the T-bar 960 to the panel 905. The example of FIG. 9B shows each of the T-Bars 960 fixed in place.

Accordingly, LED strips 932 and 934 on each panel 905 are angled at 25 degrees from the surface of its panel, or a total of 45 degrees inclusive of the 20 degree panel angle, strips 936 are set at a 35 degree angle (total 55 degree angle), and strips 938 are set at a 45 degree angle (total 65 degree angle). The differing angles of the LED strips with respect to the surface of panels 905, coupled with the arced T-bars and angled panel, enables fixture 900 to mimic or create a Type II roadway lighting pattern comparable to a 150 watt HPS cobra head lamp. Of course, other desired lighting patterns could be replicated based on adjustment of one or more of the T-bar angles, panel angle, and the use of secondary optics on one or more LEDs 935 on one or more of the LED strips 932, 934, 936, 938.

For example, the prototype fixture 900 shown in FIGS. 9A and 9B—eight arrays of 10 white LEDs each, was also used to evaluate a Type III lighting pattern. The fixture 900 was also tested with the Graesby 211 calibrated photometer system using absolute photometry to evaluate flux distribution and area coverage in simulating a Type III roadway illumination pattern. The fixture tested with electrical specifications set at 120 VAC, 1.404 A and 167.5 W. The fixture 900 achieved desirable horizontal illumination results in at least a 1.times.1 mounting height coverage area or greater on the ground below, with a tested mounting height of 25 feet. The total lumen output of the fixture was almost 8000 lumens, as indicated by the flux distribution from this test below.

TABLE 2

Flux Distribution for Prototype Fixture -- TYPE III

| LUMENS | DOWNWARD | UPWARD | TOTAL |
|---|---|---|---|
| HOUSE SIDE | 3531 | 412 | 3944 |
| STREET SIDE | 3483 | 432 | 3916 |
| TOTALS | 7015 | 844 | 7860 |

Therefore, it is within the scope of the example embodiments that the designer or end user, by adjusting the angle of the inclination of the various LED strips in multiple dimensions with respect to the panels and/or the angle of the panel from horizontal, with or without the use of optics, may mechanically simulate any desired illumination pattern.

Accordingly, the described embodiments of the LED lighting fixture herein may satisfy the requirements of the IESNA Type II roadway specification, and can be modified for Types I, III, IV, V). The adjustability features described to adjust the mounting angle and hinge angle of the panels potentially could be useful in non-traditional applications, such as lighting a curved roadway, where keeping the light from hitting an office building or residence would be desirable.

Therefore, the above example embodiments have described an LED lighting fixture having one or more panels, in which one or more of the LEDs or LED strips on the panel can be mounted at an angle to the planar surface.

In an example, multiple LEDs and multiple strips may be mounted at different angles to the planar surface. The LED strips may be straight, curved and/or angled in multiple dimensions, (e.g., both a horizontal plane from the panel surface and in a vertical plane, as shown in FIG. 8).

In a further example, one or more LEDs may be fitted with a secondary optic thereon. As shown, multiple LEDs on a panel may be fitted with different secondary optics, or a fixture can be configured without fitting optics on any of the LEDs thereon. Additionally, the type of secondary optics used can on an LED or group of LEDs can be the same for all LEDs mounted at a particular mounting angle. As such, the secondary optics for an LED or group of LEDs depends on the mounting angle or range of angles of the LED or group of LEDs. In a further embodiment, optical elements such as secondary optics and/or reflectors can be provided or fitted on LEDs around only the outer edges of a given fixture, as shown in any of FIGS. 2A through 2C, and 7A through 9B. In other words, secondary optics and/or reflectors may be fitted on LEDs along the outer edges of each of the four sides of the fixture to direct light downward and/or to avoid illumination of unintended spaces, (through the use of reflectors or optics to re-direct the light at the edges of the fixture). Also, as shown in FIGS. 7A and 7B, the angle at which a given LED of LED strip is mounted to the panel can be fixed or variable. As shown in FIGS. 2C, 3C, 8, 9A and 9B, the angle at which one or more LEDs or LED strips are mounted to the panel can be fixed or variably adjusted in multiple dimensions. In the embodiments described, the groups of LEDs may be mounted on strips that are mounted at different angles. so that the LEDs in a group of LEDs on a given strip are mounted at the same angle. However, the LED strips or mounting surfaces for the LEDs can be curved as shown in FIG. 9A so that a group of LEDs mounted on a strip will have a range of angles.

The example embodiments of the present invention being thus described, it will be understood that the same may be varied in many ways. Although the example embodiments have been described with using a plurality of longitudinally arranged LED strips mounted on the surface of the panels, other configurations of LED arrays or LED groups may be utilized to achieve a desired illumination pattern.

For example, a bowl or odd U-shaped module may be affixed to the planar surfaces 107 of the panels 105 so as to provide a semicircular mounting surface for an array of LEDs 135 thereon. This may enable the LEDs 135 to be mounted at several different angles to achieve a desired distribution of light for a particular application.

Figure 10A:
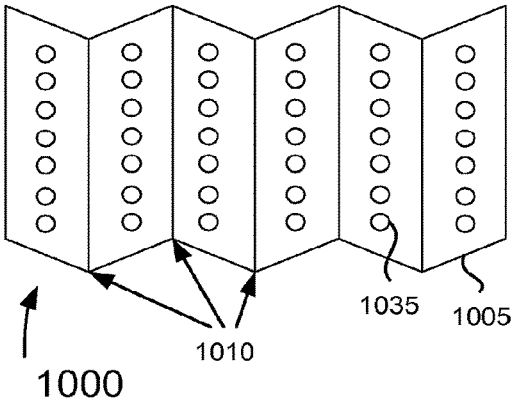
FIG. 10A illustrates a bottom view of a LED lighting fixture in accordance with another example embodiment.
Figure 10B:
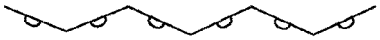
FIGS. 10B-10D illustrate variations in a front view of the fixture in FIG. 10A.
Figure 10D:
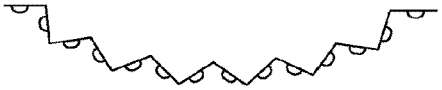
Figure 10C:
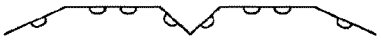

FIG. 10A illustrates a bottom view of a LED lighting fixture in accordance with another example embodiment, and FIGS. 10B-10D illustrate variations in a front view of the fixture in FIG. 10A. The fixture 1000 in FIG. 10A illustrates the use of panels or LED boards 1005 which may be set or adjusted at multiple different angles. The LED boards 1005 may be formed from a single piece of metal that is shaped as shown in FIG. 10A, so as to provide a fixture 1000 comprised of multiple boards at multiple different angles. The fixture 1000 may thus be configured to assume different angled configurations, as shown in FIGS. 10B to 10D for example. Each board 1005 may include an array, group or matrix of LEDs 1035 thereon. Various LEDs 1035, groups or arrays of LEDs may be configured with or without optical elements, as shown in FIGS. 2A, 2B and 3A-3C for example. In an alternative example, each of the boards 1005 may be hinged together at angle points 1010.

Figure 11A:
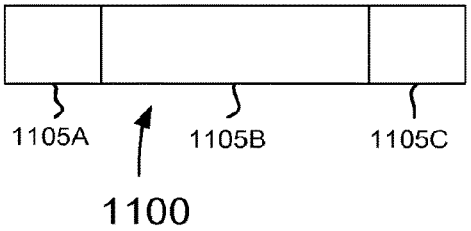
FIG. 11A is a bottom view of a three-panel LED lighting fixture in accordance with another example embodiment.
Figure 11B:
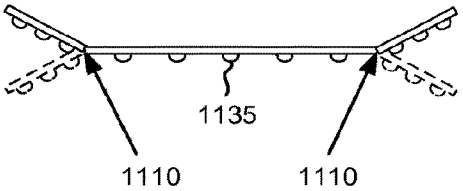
FIG. 11B is a front view of the LED lighting fixture of FIG. 11A.

Similarly, FIGS. 11A and 11B shows a three-paneled embodiment, with panels 1105A, 1105B and 1105C are configurable to be set at multiple different angles from each other. Various LEDs 1135 or arrays or groups of LEDs may be configured with or without secondary optics, as shown in FIGS. 2A, 2B and 3A-3C for example. The fitting of secondary optics such as optics 150, 155 on LEDs which are affixed on a fixture 1100 with multiple-angled panels or boards 1105 may facilitate the replication of a desired beam pattern.

Figure 12:
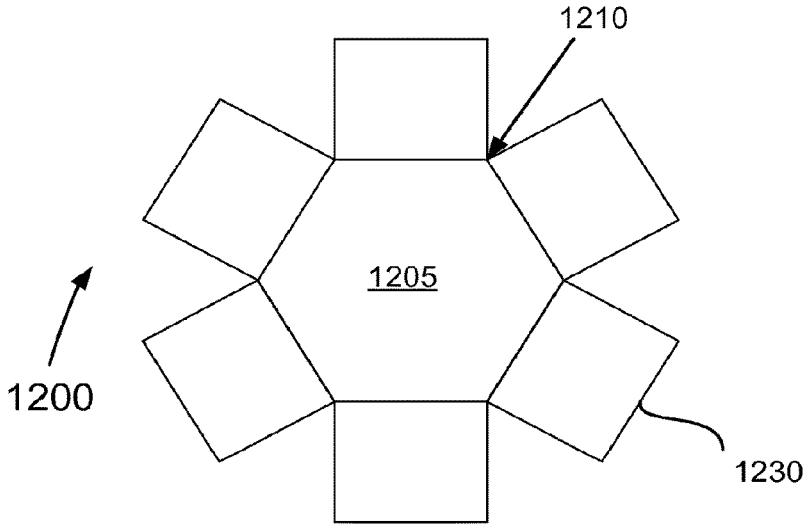
FIG. 12 is a planar or bottom view of a LED lighting fixture in accordance with another example embodiment.
Figure 13:
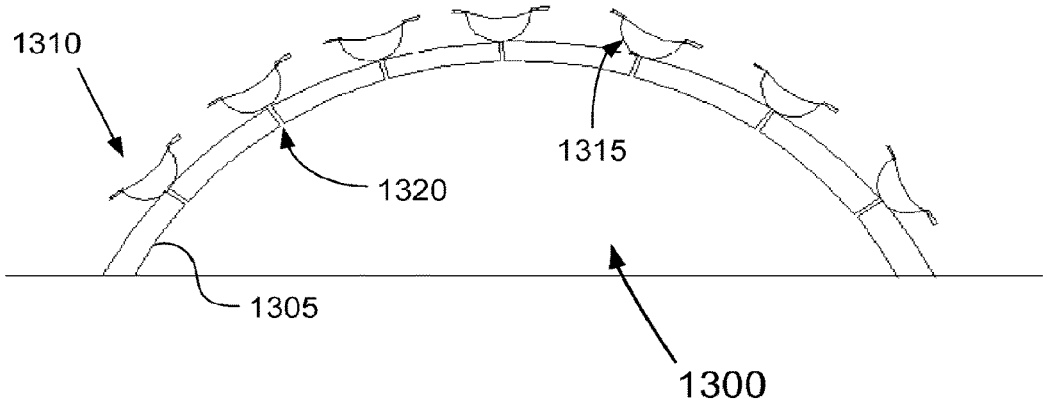
FIG. 13 is a side view of a LED lighting fixture in accordance with another example embodiment.

FIG. 12 illustrates a planar or bottom view of a LED lighting fixture in accordance with another example embodiment. In FIG. 12, a central panel 1205 may be connected to multiple LED boards 1230 at multiple angle points 1210. The fixture 1200 may be formed from one piece of metal, or may include multiple panels attached to one another. The LED boards 1230 may be any desired shape, such as hexagonal, square, triangular etc. Each LED board 1230 may include various LEDs (not shown) or arrays or groups of LEDs mounted thereon, which may be configured with or without secondary optics such as optics 150, 155 as shown in FIGS. 2A, 2B and 3A-3C for example. FIG. 13 is a side view of a LED lighting fixture in accordance with another example embodiment. In FIG. 13, fixture 1300 includes a wound copper tube or coil, which as shown has been cut in half so as to form an arced tube portion 1305. The copper tubing can be sized to any desired length. An example copper tubing product may be a ½ inch inside diameter Type L copper coiled tubing such as a CERRO Model 01216 copper tubing product, it being understood that tubing having different diameters and lengths may be used for a given application. Further, although the tube portion 1305 is described as being made of copper for its excellent thermal conduction properties, the arced tube portion 1305 may be composed of another metal having excellent thermal properties. It is understood that materials with good thermal conductivity other than copper may also be used such as silver, alloys of copper or silver or other metal materials having high thermal conduction properties.

In FIG. 13, the copper tube 1305 includes a plurality of bell hangers 1310 attached thereto. The bell hangers 1310 are generally bell shaped, and are attached to the arced tube portion 1305 by a pair of clamps with clamp screws (not shown for purposes of clarity), such that the bell hangers 1310 can be moveably positioned back and forth (or side to side) around the surface of arced tube portion 1305. An example bell hanger 1310 may be a SIOUX CHIEF ½ inch copper bell hanger, model number L20351, which includes a pair of claims, two clamp screws and a recessed mounting screw.

An LED (not shown in FIG. 13) may be mounted inside the cup or bell portion 1315 of each bell hanger 1310 on a MCPCB, such as a 1".times.1" MCPCB, for example. Given LEDs may be fitted with optical elements such as secondary optics and/or reflectors as desired for a given lighting application.

The fixture 1300 is highly flexible, and each of the bell hangers 1310 can be fully adjustable. Once a desired lighting pattern is achieved, the bell hangers 1310 can be fixed in place, and holes or apertures may be drilled into the copper tubing (shown generally at 1320) to permit the wires from at least one constant current driver (not shown) to be connected to the LEDs inside the bell portion 1315.

Figure 14:
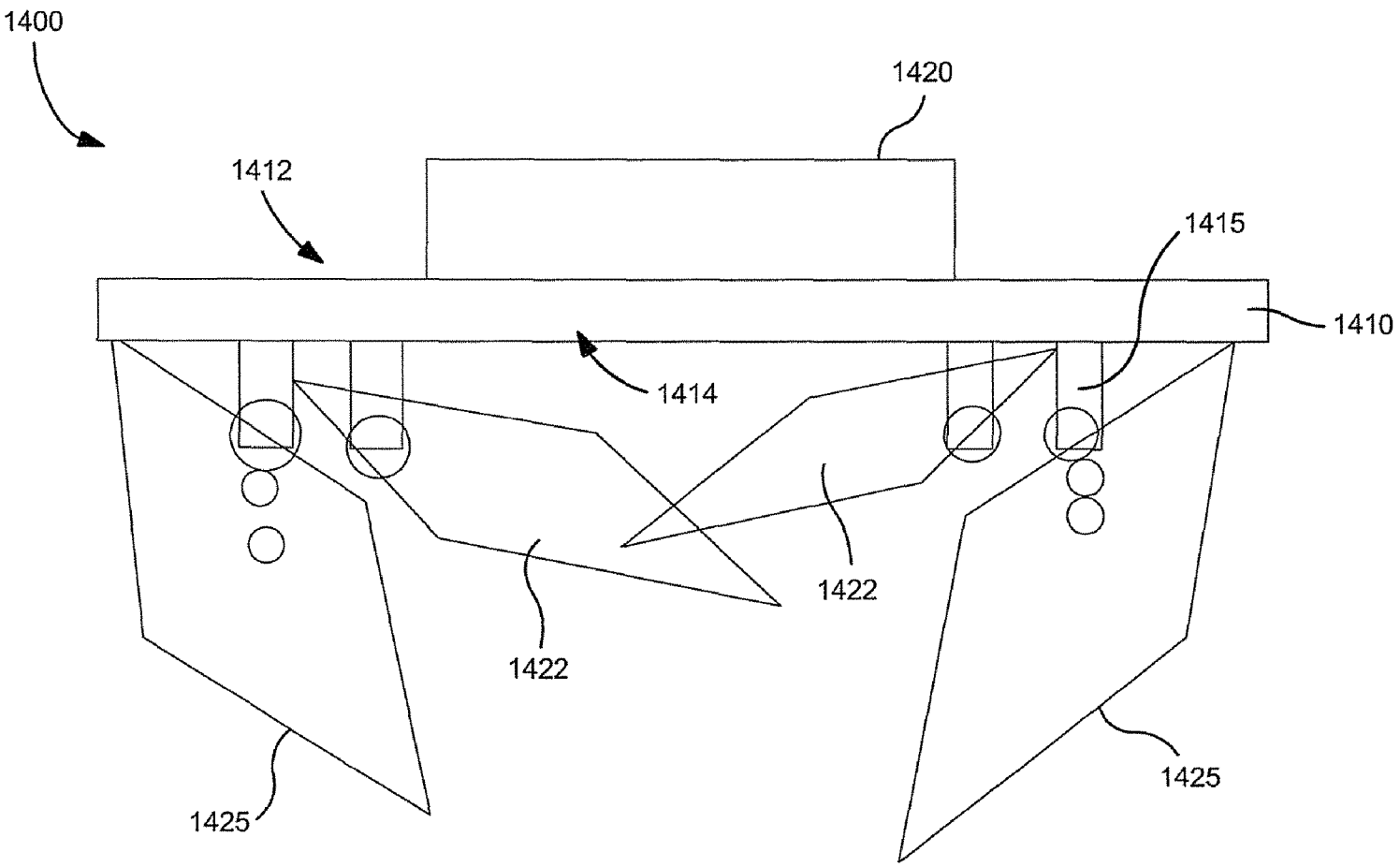
FIG. 14 is front view of an LED fixture according to another example embodiment.

FIG. 14 is front view of an LED fixture 1400 according to another example embodiment. The fixture 1400 includes a support plate 1410 which is shown in this configuration as a 12 inch by 12 inch metal plate. In another example, support plate 1410 may be an 18".times.18" aluminum plate having a thickness of 0.125 in. A power supply 1420 is attached on a back surface 1412 of support plate 1410. An example power supply 1420 can be a 36V, 4.2 amp constant current driver. In this example, a plurality of LED panels (a pair of rear panels 1422 and a pair of front panels 1425) are connected to a bottom surface 1414 of the support plate 1410 via a plurality of support arms 1415 which are attached to hinges (not shown) on the back side of the panels 1422/1425. In this example, each of the panels 1422, 1425 is shown as 6 inch by 6 inch aluminum plate, with each plate having an LED array mounted thereon. The example embodiments are not limited by these dimensions, and the panels 1422, 1425 can be attached directly to bottom surface 1414 of support plate 1410 by rotatable hinge mount assemblies, as will be shown in more detail below.

In an example, the LED array 1430 on each panel 1422,1425 can include 30 LEDs 1435. The LEDs can be arranged in a serial manner on sets of adjacent PCB strips 1432. The PCB strips 1432 can be mechanically fastened or adhered by a suitable glue or epoxy directly to a surface of each panel 1422, 1425.

Figure 15:
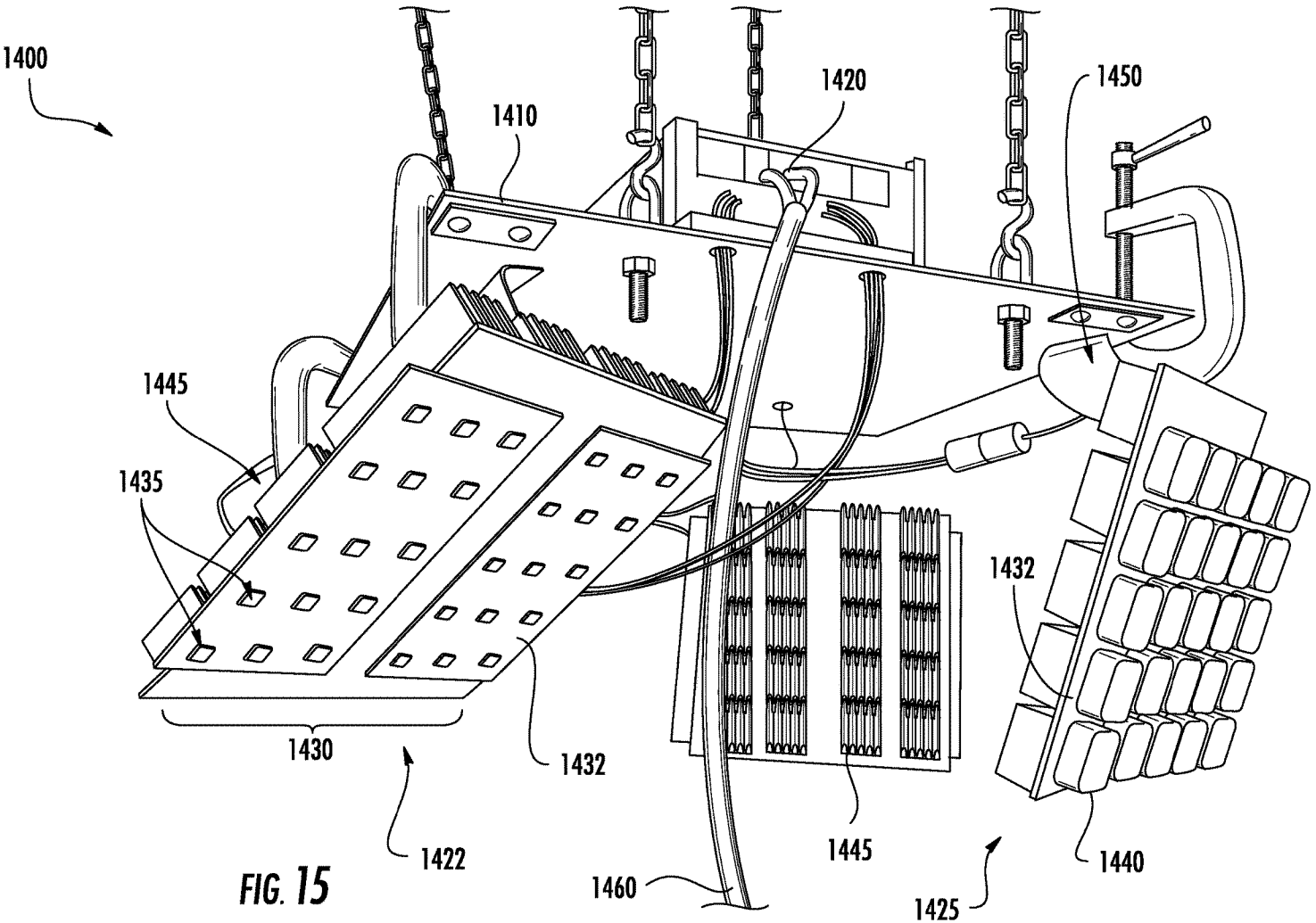
FIG. 15 is a perspective side view of a prototype LED lighting fixture.

In an example, the wall system power applied to the driver 1420 for driving the LED arrays on each panel 1422, 1425 can be 120 VAC, 2.181 A, 169.8 W wall plug power. The ballast output for this example can be 30.10 VDC, at 4.776 ADC and 143.8 WDC. However, the example embodiments are not limited to the above applied power and ballast output ratings, and can be adjusted based on the number of LED lamps to be powered by driver 1420. FIG. 15 is a perspective side view of a built prototype LED lighting fixture showing one rear plate 1422 and one front plate 1425 in further detail. The rear plate 1422 includes a plurality of LED strips 1430 which have a plurality and LEDs 1435 thereon. Each panel 1422, 1425 in one example can include an array 1430 of 30 LEDs arranged in a serial manner on sets of adjacent PCB strips 1432. As discussed above, the PCB strips 1432 can be MCPCBs that are mechanically fastened or adhered by a suitable glue or epoxy directly to a surface of each panel 1422, 1425. In an alternate embodiment, each strip 1432 can be attached to a U-bar which is rotatably or fixedly attached to a panel 1420, 1425, such as is shown in any of FIGS. 3A-3C, 4A and 5C, for example.

A plurality of heat spreading fins 1445 can be attached to a back side of the rear panel 1422. These fins 1445 may be provided on each of the panels 1422, 1425. Also known as heat spreading T-bars, the fins 1445 are provided with channel spacings there between to facilitate thermal dissipation. In one example, these fins 1445 can be formed as part of a single cast modular panel 1422, 1425. The fins 1445 therefore provide a heat spreading function to remove heat generated by the LEDs 1435 within fixture 1400. FIG. 15 also illustrates an AC power cord 1460 which supplies AC power to the driver 1420 on the top surface 1412 of support plate 1410.

In this example, the LEDs 1435 on the LED strips 1432 and the rear panel 1422 do not include secondary optics or reflectors. However, each of the front panels 1425 includes LEDs 1435 that have a secondary optic, shown as a reflector 1440. As noted, a secondary optic modifies the pattern and/or direction of emitted LED light into shapes such as ovals, circles, etc. depending on the type of secondary optic. Accordingly, different types of optics 1440 can be used on the front panels 1425 to obtain different lighting illumination patterns.

For the fixture 1400 shown in FIG. 15, each array 1430 on a panel 1422, 1425 includes six (6) PCB strips 1432, each strip 1430 having five (5) LEDs arranged in a serial manner thereon. In an example, the LEDs 1435 may be Cree XLamp® XR-E white LEDs, with an average lumen count of 80 lumens per LED at 350 mA of constant current. The LEDs 1435 on the front panels 1425 are configured with 25.degree. circle optics 1440.

Each of the panels 1422, 1425 is oriented in two different planes to achieve a desired lighting pattern. One angle is taken from an illumination direction in which the illumination is pointed straight down from the fixture 1400; this vertical plane direction represents a 0 degrees, with a horizontal plane that bisects the fixture 1400 representing a 90 degree angle from vertical. The angle formed between the vertical 0 degree point and the horizontal 90 degree point determines the length of the lighting distribution pattern, whether that length is true side to side length or the length of the "batwing" tips of the lighting pattern. This angle will be referred to herein as the vertical angle.

The second angle of concern is the angle that a panel 1422/1425 is rotated from a horizontal plane that intersects the side (left or right) of the fixture 1400, representing a 0 degree angle, to a horizontal plane in front of fixture 1400, which would be 90 degrees. This may be referred to as a "lateral angle", from side to front. This lateral angle determines the width of the light pattern.

Collectively, both the vertical angle and the lateral angle at which each panel is set determines the length, width, and shape of the light pattern; each angle has a greater influence on one characteristic of the light pattern than another; i.e., the vertical angle has a greater influence on the length of the light pattern, the lateral angle a greater influence on the width of the lighting pattern formed by fixture 1400.

As shown in FIG. 15, the vertical and lateral angles for each panel 1422, 1425 can be set by adjusting a swivel mount assembly 1450. The swivel mount assembly can be any off-the-shelf swivel mount sold for various applications, for example. The swivel mount assembly 1450 attaches each panel 1422, 1425 to the bottom surface 1414 of the support plate 1410, and permits rotation of the panels 1422, 1425 in the vertical and lateral directions as needed to enable the fixture 1400 to produce a desired lighting pattern.

The front panels 1425 point the illumination with narrow optics to a maximum candela point and create a half max candela area that decides the type of lamp that the IESNA will categorize based on the structure. In other words, the use of narrow secondary optics (such 25.degree. circle optics 1440) helps to ensure that the max candela is directed with the front panels 1425. The two rear panels 1422 without optics "backfill" the pattern with a lower level of illumination. The panels 1422, 1425 thus can be configured to create a full illumination pattern that, in an example, can mimic a conventional HPS roadway cobrahead fixture.

The fixture 1400 as shown in FIG. 15 includes LEDs 1535 on the front panel each including 25.degree. circle optics 1440. The vertical by lateral plate angles for panels 1425 are set at 73.degree.times.73.degree. Both of the rear panels 1425 are set at 45.degree. (vertical).times.45.degree. (lateral) and include LEDs 1435 without optics. These settings provide a LED lighting fixture 1400 configured to duplicate a Type II roadway pattern made by a 150 W HPS cobrahead streetlamp.

In another example, the front panels 1425 were each set with angles at 70.degree. (vertical).times.70.degree. (lateral), and the rear panels 1422 set with angles at 35.degree.times.35.degree. The prototype fixture 1400 shown in FIG. 15, six arrays of 30 white LEDs each, was used to evaluate a Type II lighting pattern. The fixture 1400 was tested with the Graesby 211 calibrated photometer system using absolute photometry to evaluate flux distribution and area coverage in simulating a Type II roadway illumination pattern. The following flux distribution obtainable by the fixture 1400 is shown in Table 3.

TABLE 3

Flux Distribution - LED Lighting Fixture 1400

| Lumens | Downward | Upward | Total |
|---|---|---|---|
| House Side | 1400 | 139 | 1539 |
| Street Side | 6804 | 457 | 7261 |
| Totals | 8204 | 596 | 8800 |

The total lumen output of fixture exceeded 8000 lumens in the downward direction, with a total lumen output of at least 8800 lumens, as indicated by the flux distribution above.

Accordingly, the above data indicates that a streetlamp can be configured with an LED lighting fixture using existing LEDs to duplicate a Type II roadway pattern. It would be evident to the skilled artisan to adjust the angles of the panels 1422/1425 as well as the number and orientation of LEDs 1435 thereon to obtain other IESNA roadway patterns. For example, configuring panels 1425 with correct reflectors/lenses 1440 and setting the front and rear panels 1422, 1425 to proper vertical and lateral angles enable the fixture 1400 to produce Type I to Type IV roadway patterns.

Accordingly, the plurality of panels can thus be adjusted to create different light distribution patterns. The front panels 1425 with optics 1440 set the IESNA specification for the width and length of the desired pattern, and the rear panels 1422 having LEDs 1435 without optics fill in the distribution pattern towards the center of illumination.

The distribution pattern represents illumination levels on the ground and potential levels directed in a given area. Therefore, the example embodiments illustrate that pattern possibilities for the example LED lighting fixture may be infinite. As the viewing (vertical) angles are changed, and the directional (lateral) angles are changed, the pattern can be shaped in almost any way.

Additionally, by adjusting the front two panels 1425, the max/half-max areas can be placed anywhere in the pattern, mimicking any IESNA patterns for roadway and/or area lighting. Moreover, as LEDs become more powerful, the example fixture 300 design may be even more flexible by allowing designers to further increase illumination distance, mounting height, and general brightness.

The example embodiments being thus described, it will be obvious that the same may be varied in many ways. Although not shown, one or more LED lamps herein may be fitted with a secondary optic that shapes the light output in a desired shape, such as circle, ellipse, trapezoid or other pattern. Such variations are not to be regarded as departure from the spirit and scope of the example embodiments of the present invention, and all such modifications as would be obvious to one skilled in the art are intended to be included within the scope of the following claims.

What is claimed is:

1. A light-emitting diode (LED) lighting fixture, comprising:

a support plate provided along a horizontal plane;

a panel connected to the support plate, the panel being movable with respect to the support plate for adjusting the panel to one or more different angles with respect to the horizontal plane of the support plate; and at least two LEDs provided on the panel, wherein the LEDs are provided in at least two different mounting angles with respect to the panel for creating a desired illumination pattern; and an optical element fitted around and surrounding multiple sides of a first LED of the two LEDs, the optical element being configured to shape light output from the first LED in a desired shape, and wherein a second LED of the at least two LEDs is devoid of an optical element fitted around and surrounding multiple sides thereof.

2. The LED lighting fixture of claim 1, wherein the LEDs are configured to emit a same color of light.

3. The LED lighting fixture of claim 1, wherein the LEDs are configured to emit different colors of light.

4. The LED lighting fixture of claim 1, wherein the optical element comprises a spot optic.

5. The LED lighting fixture of claim 1, wherein the panel is curved, and the LEDs are provided over a curved surface of the panel.

6. The LED lighting fixture of claim 1, wherein the LEDs are provided over a planar surface of the panel.

7. The LED lighting fixture of claim 1, further comprising a plurality of LEDs arranged in multiple rows of LEDs.

8. The LED lighting fixture of claim 1, further comprising a plurality of LEDs arranged in a circular pattern over the panel.

9. The LED lighting fixture of claim 1, further comprising:

a plurality of adjustable panels connected to the support plate, each panel of the plurality of panels having a planar surface and at least one bar attached to and extending from the planar surface with an LED strip mounted to the at least one bar; and at least one of the panels of the plurality of panels is positioned at an angle relative to the horizontal plane to create a desired illumination pattern.

10. The LED lighting fixture of claim 9 wherein the panels with LED strips thereon are configured to provide a total light output of between about 6,000 and about 9,000 lumens.

11. The LED lighting fixture of claim 9, wherein the panels with LED strips thereon are configured to provide a light output of at least about 8,000 lumens in a desired direction.

12. The LED lighting fixture of claim 9, wherein the plurality of panels comprise front panels and rear panels, the front and rear panels being individually adjustable to create the desired illumination pattern.

13. A method of providing light-emitting diode (LED) lighting fixture, comprising:

providing a support plate provided along a horizontal plane;

connecting a panel to the support plate;

moving the panel with respect to the support plate for adjusting the panel to one or more different angles with respect to the horizontal plane of the support plate;

mounting at least two LEDs over the panel, wherein the LEDs are mounted in at least two different mounting angles with respect to the panel for creating a desired illumination pattern; and fitting an optical element around multiple sides of a first LED of the two LEDs, the optical element being configured to shape light output from the first LED in a desired shape, wherein a second LED of the at least two LEDs is devoid of an optical element fitted around multiple sides thereof.

14. The method of claim 13, wherein the LEDs are configured to emit a same color of light.

15. The method of claim 13, wherein the LEDs are configured to emit different colors of light.

16. The method of claim 13, wherein fitting the first LED with an optical element comprises fitting the first LED with a spot optic.

17. The method of claim 13, further comprising mounting a plurality of LEDs in multiple rows of LEDs.

18. The method of claim 13, further comprising mounting a plurality of LEDs in a circular pattern over the panel.

19. The method of claim 13, further comprising:

connecting a plurality of adjustable panels to the support plate, each panel of the plurality of panels having a planar surface and at least one bar attached to and extending from the planar surface with an LED strip mounted to the at least one bar; and positioning at least one panel of the plurality of panels at an angle relative to the horizontal plane to create a desired illumination pattern.

20. The method of claim 19, wherein the panels with LED strips thereon are configured to provide a total light output of between about 6,000 and about 9,000 lumens.

21. The method of claim 19, wherein the panels with LED strips thereon are configured to provide a light output of at least about 8,000 lumens in a desired direction.

22. The method of claim 19, wherein the plurality of panels comprise front panels and rear panels, the front and rear panels being individually adjustable to create the desired illumination pattern.

* * * * *